US007006061B2

(12) United States Patent
Takeuchi et al.

(10) Patent No.: US 7,006,061 B2
(45) Date of Patent: Feb. 28, 2006

(54) DISPLAY DEVICE

(75) Inventors: Yukihisa Takeuchi, Nishikamo-gun (JP); Tsutomu Nanataki, Toyoake (JP); Iwao Ohwada, Nagoya (JP); Yasuharu Kuno, Nagoya (JP); Takayoshi Akao, Kasugai (JP)

(73) Assignee: NGK Insulators, Ltd., Nagoya (JP)

( * ) Notice: Subject to any disclaimer, the term of this patent is extended or adjusted under 35 U.S.C. 154(b) by 318 days.

(21) Appl. No.: 10/395,821

(22) Filed: Mar. 24, 2003

(65) Prior Publication Data

US 2003/0222862 A1 Dec. 4, 2003

Related U.S. Application Data

(63) Continuation-in-part of application No. 10/280,106, filed on Oct. 24, 2002, now abandoned, which is a continuation-in-part of application No. 10/163,069, filed on Jun. 5, 2002, now abandoned.

(30) Foreign Application Priority Data

| | | |
|---|---|---|
| Jun. 4, 2002 | (JP) | 2002-163194 |
| Oct. 18, 2002 | (JP) | 2002-304600 |
| Mar. 24, 2003 | (JP) | 2003-081343 |

(51) Int. Cl.
*G09G 3/30* (2006.01)

(52) U.S. Cl. ..... 345/76; 345/90

(58) Field of Classification Search ..... 345/76, 345/67, 69, 80, 84, 87, 90, 91, 93, 98, 204–213, 345/596, 690, 691, 77, 92, 100
See application file for complete search history.

(56) References Cited

U.S. PATENT DOCUMENTS

| | | | |
|---|---|---|---|
| 5,757,008 | A | 5/1998 | Akagawa et al. |
| 5,862,275 | A | 1/1999 | Takeuchi et al. |
| 6,281,868 | B1 * | 8/2001 | Takeuchi et al. ..... 345/90 |
| 6,323,833 | B1 | 11/2001 | Takeuchi et al. |

(Continued)

FOREIGN PATENT DOCUMENTS

EP 0 675 477 A1 10/1995

(Continued)

OTHER PUBLICATIONS

U.S. Appl. No. 09/570,697, filed May 12, 2000, Takeuchi et al.

*Primary Examiner*—Vijay Shankar
*Assistant Examiner*—Nitin Patel
(74) *Attorney, Agent, or Firm*—Burr & Brown

(57) ABSTRACT

A display device has first row select lines for selecting rows of picture elements, picture element signal lines for supplying picture element signals to picture elements which are selected, a drive unit having drive circuits arrayed at respective picture elements each for driving the corresponding actuator in response to a picture element signal, and a selector unit for selecting the actuators corresponding to selected picture elements. Each of the drive circuits has a drives potential generating circuit for applying a drive potential based on a signal from a picture element signal line to upper electrodes of actuators. The selector unit has selector circuits for applying a select potential to lower electrodes of the actuators corresponding to selected picture elements.

23 Claims, 25 Drawing Sheets

U.S. PATENT DOCUMENTS

| | | | | |
|---|---|---|---|---|
| 6,426,734 | B1 | 7/2002 | Sano | |
| 6,452,583 | B1 | 9/2002 | Takeuchi et al. | |
| 6,483,492 | B1 * | 11/2002 | Takeuchi et al. | 345/63 |
| 6,628,258 | B1 | 9/2003 | Nakamura | |
| 6,707,438 | B1 | 3/2004 | Ishizuka et al. | |
| 6,720,958 | B1 | 4/2004 | Walsh | |
| 6,724,378 | B1 | 4/2004 | Tamura et al. | |
| 6,778,162 | B1 * | 8/2004 | Kimura et al. | 345/90 |
| 6,819,317 | B1 * | 11/2004 | Komura et al. | 345/204 |
| 2003/0016202 | A1 | 1/2003 | Edwards et al. | |
| 2003/0201986 | A1 * | 10/2003 | Willis et al. | 345/204 |

FOREIGN PATENT DOCUMENTS

| | | |
|---|---|---|
| JP | 7-287176 | 10/1995 |
| JP | 10-78549 | 3/1998 |
| WO | WO98/54609 | 12/1998 |

* cited by examiner

DISPLAY DEVICE

BACKGROUND OF THE INVENTION

1. Field of the Invention

The present invention relates to a display device comprising a display limit which has an array of capacitive elements arranged at respective picture elements and displaceable for turning on and off the corresponding picture elements, and a drive unit which has an array of drive circuits arranged at respective picture elements for driving the corresponding capacitive elements in response to input signals.

2. Description of the Related Art

The applicant of the present application has proposed a display device employing ceramic components as disclosed in Japanese laid-open patent publication No. 7-287176, for example. As shown in FIG. 22 of the accompanying drawings, the proposed display device has an array of actuators 200 associated with respective picture elements. Each of the actuators 200 has an actuator unit 208 comprising a piezoelectric/electrostrictive layer 202, an upper electrode 204 mounted on an upper surface of the piezoelectric/electrostrictive layer 202, and a lower electrode 206 mounted on a lower surface of the piezoelectric/electrostrictive layer 202, and a base body 214 comprising a vibrating section 210 disposed underneath the actuator unit 208 and a fixed section 212 joined to the vibrating section 210. The lower electrode 206 is held against the vibrating section 210, which supports the actuator unit 208 thereon.

The vibrating section 210 and the fixed section 212 are integrally formed of ceramics. The base body 214 has a recess 216 defined therein beneath the vibrating section 210 so that the vibrating section 210 is thinner than the fixed section 212.

A displacement transfer element 220 for providing a predetermined area of contact with an optical waveguide plate 218 is joined to the upper electrode 204. In FIG. 22, when the actuator 200 is in a normal state in which it is held at rest, the displacement transfer element 220 is positioned in the vicinity of the optical waveguide plate 218, and when the actuator 200 is in an energized state, the displacement transfer element 220 is brought into contact with the optical waveguide plate 218 by a distance equal to or smaller than the wavelength of light.

Light 222 is introduced into the optical waveguide plate 218 from a lateral end thereof, for example. The optical waveguide plate 218 has its refractive index pre-adjusted to cause all the light 222 to be totally reflected within the optical waveguide plate 218 without passing through front and rear surfaces thereof. When a voltage signal depending on the attributes of an image signal is selectively applied to the actuator 200 via the upper electrode 204 and the lower electrode 206 to hold the actuator 200 in the normal state or displace the actuator 200 in the energized state, the displacement transfer element 220 is controlled to move into or out of contact with optical waveguide plate 218. Thus, dispersed light (leaking light) 224 from a given area, aligned with the actuator 200, of the optimal waveguide plate 218 is controlled to display an image depending on the image signal on the optical waveguide plate 218.

The proposed display device is advantageous in that (1) the power consumption thereof can be reduced, (2) the illuminance of the display screen can be increased, and (3) when it is used in color display applications, it does not need to have more picture elements than black-and-white display device.

FIG. 23 of the accompanying drawings shows the above display device including peripheral circuits. The display device includes a display unit 230 having a matrix of picture elements, and the peripheral circuits include a vertical shift circuit 234 from which there extend as many vertical select lines 232 as the number of rows of picture elements, each of the vertical select lines 232 being shared by a number of picture elements (a group of picture elements) making up one row, and a horizontal shift circuit 238 from which there extend as many horizontal select lines 236 as the number of columns of picture elements, each of the horizontal select lines 236 being shared by a number of picture elements (a group of picture elements) making up one column.

Display information (output voltage) outputted from horizontal shift circuit 238 to a group of picture elements in a selected row is also applied to a group of picture elements in unselected rows, resulting in the driving of unnecessary picture elements (actuators). Therefore, the display device consumes an unwanted amount of electric energy, and is not suitable for low power consumption designs.

When all the rows are selected in a vertical scanning period, the display screen fails to produce images of high illuminance because the picture elements emit light only in a period of time represented by (vertical scanning period/required number of selected rows).

As shown in FIG. 24 of the accompanying drawings, one solution would be to use horizontal shift circuits 238 associated with the respective rows. The solution, however, is disadvantageous in that the resultant circuit arrangement would be very complex.

The applicant has proposed a new display device in order to solve the above problems (see the publication WO98/54609).

As shown in FIG. 25 of the accompanying drawings, the proposed display device, denoted by 300, has a switching thin film transistor (TFT) 308 disposed in the vicinity of an actuator 306 which comprises a lower electrode 302*b*, a shape holding layer 304, and an upper electrode 302*a* that are disposed on a drive unit.

The upper electrode 302*a* of the actuator 306 and a source/drain region 310 of the TFT 308 are electrically connected to each other by a contact 312. A select line 314 and a gate electrode of the TFT 308 are electrically connected to each other by a contact 316. A signal line 318 and a source/drain region 320 of the TFT 308 are electrically connected to each other by a contact 322.

With the above arrangement, it is possible to lower the power consumption, increase the illuminance, and simplify the formation of interconnections of the display device 300 which employs the actuator 306 including the shape holding layer 304.

The actuator 306 has a capacitor structure having a pair of electrodes which have a large capacitance. A 15-inch liquid crystal display unit having 1024×768 dots (XGA) has a square cell size of 0.295 mm on each side and an capacitance of 0.9 pF (dielectric constant $\epsilon r$=6.8, cell gap=6 $\mu$m). If the display device 300 has a 40-inch size and 1 g an XGA, then it has a square cell size of 0.8 mm on each side and an capacitance of 0.8 nF.

Since the display device 300 having the actuator 306 including the shape holding layer 304 has a larger capacitance than liquid crystal display units, it needs to be energized by a high voltage and a large current. If the TFT 308 is used as a switching element, then it suffers a withstand voltage problem. It is thus necessary to reduce the area of the actuator 306 per picture element to reduce the capacitance, but the aperture ratio of the picture element is reduced and the illuminance tends to be lowered.

If switching elements are constructed separately as an integrated circuit (IC), then a number of interconnections need to be provided between a drive circuit which has as many switching elements as the number of picture elements and a substrate on which actuators 306 are formed (actuator substrate). The proposal thus poses a new problem in that it is difficult to form interconnection patterns on the actuator substrate.

SUMMARY OF THE INVENTION

The present invention has been made in view of the above problems. It is an object of the present invention to provide a display device which, even if it uses TFTs as switching elements, can solve a withstand voltage problem of the switching elements, and can provide a sufficient area of capacitive elements (such as an area of actuators, picture element aperture ratio, etc.).

Another object of the present invention is to provide a display device which can optimize the layout of various interconnections, allows drive circuits to be formed without reducing the area of capacitive elements, and can provide a sufficient picture element aperture ratio.

According to the present invention, there is provided a display device comprising a display unit having capacitive elements arrayed so as to correspond respective picture elements and displaceable for turning on and off the corresponding picture elements, each of the capacitive elements having a capacitor structure having a pair of electrodes, a plurality of select lines for supplying the picture elements with instructions of selection and unselection, a plurality of signal lines for supplying respective picture element signals to each of the picture elements which have been selected, a drive unit having drive circuits arrayed so as to correspond respective picture elements and driving an capacitive element selected from said capacitive elements in response to an instruction from one of the select lines and a signal from one of the signal lines, and a selector unit for selecting said capacitive element which corresponds to the selected respective picture elements, each of the drive circuits having a drive potential generating circuit for applying a drive potential based on the signal from the signal line to one of electrodes having said capacitive element, the selector unit having selector circuits for applying select potentials to the other of the electrodes having said capacitive element corresponding to the selected picture elements.

When a certain picture element is selected through a select line, a drive potential based on a signal from the signal line is applied by the drive potential generating circuit to one of the electrodes of the capacitive element which corresponds to the selected picture element, and a select potential is applied by the selector circuit to the other electrode of the capacitive element. A voltage applied to the electrodes of each of the capacitive elements is determined by the potential difference between the drive potential and the select potential.

Each of the capacitive elements needs to be energized by a high voltage and a large current as its capacitance is large compared with liquid crystal display units or the like. If a certain potential is applied to the other electrode of the capacitive element to energize the capacitive element under the potential difference between the applied certain potential and the drive potential from the drive potential generating circuit, then the drive potential has to have an amplitude large enough to energize the capacitive element. For example, if the capacitive element is to be energized in a voltage range from 10 V to 50 V, then the drive potential needs to have a large amplitude of 60 V, for example.

According to the present invention, since the drive voltage applied to the electrodes of each of the capacitive elements can be set as the potential difference between the drive potential and the select potential, the amplitudes of the drive potential and the select potential can be set to a low amplitude which may be ½, for example, of the amplitude capable of energizing the capacitive element.

Consequently, it is not necessary to reduce the area of each of the capacitive elements. The display device is free of the withstand voltage problem of TFTs even if a circuit including such TFTs is used in the drive circuits, and allows the capacitive elements to have a sufficient area (picture element aperture ratio).

In the above arrangement, the each of the drive circuits may control the drive potential generating circuit to translate an output thereof into three states based on the signal from the signal line.

Specifically, the drive potential generating circuit may have an output signal of a high potential level or an output signal of a low potential level, or present a high output impedance. The high output impedance provided by the drive potential generating circuit is effective to reduce power consumption as no current flows when the drive potential generating circuit has the high output impedance.

Each of the drive circuits may comprise a first logic gate for inhibiting a first signal from being inputted from a first control line included in the signal line when not selected and allowing the first signal to be inputted from the first control line when selected based on a select signal from one of the select lines, and a second logic gate for inhibiting a second signal from being inputted from a second control line included in the signal line when not selected and allowing the second signal to be inputted from the second control line when selected based on the select signal from the select line, wherein each of the drive circuits may control the drive potential generating circuit to translate the output thereof into three states based on first and second signals from the signal line.

The drive potential generating circuit may, for example, produce an output signal of a high potential level or an output signal of a low potential level, or present a high output impedance depending on the level (logic value) of the first and second signals.

The drive potential generating circuit may have a series circuit of a first thin-film transistor and a second thin-film transistor which are connected between a high level power supply and a low-level power supply, the arrangement being such that the first signal is applied to a gate of the first thin-film transistor and the second signal is applied to a gate of the second thin-film transistor.

The first thin-film transistor may have a channel of a first conductivity type and the second thin film transistor may have a channel of a second conductivity type.

With the above arrangement, if the first signal is of logic "1" and the second signal is of logic "1", then the first thin-film transistor is turned off and the second thin-film transistor is turned on, causing the drive potential generating circuit to produce a low-level output signal.

If the first signal is of logic "0" and the second signal is of logic "0", then the first thin-film transistor is turned on and the second thin-film transistor is turned off, causing the drive potential generating circuit to produce a high-level output signal.

If the first signal is of logic "1" and the second signal is of logic "0", then both the first thin-film transistor and the second thin-film transistor are turned off, causing the drive potential generating circuit to present a high output impedance.

The first thin-film transistor and the second thin-film transistor may have respective channels of the same conductivity type.

With the above arrangement, if the first signal is of logic "0" and the second signal is of logic "1", then the first thin-film transistor is turned off and the second thin-film transistor is turned on, causing the drive potential generating circuit to produce a low-level output signal.

If the first signal is of logic "1" and the second signal is of logic "0", then the first thin-film transistor is turned on and the second thin-film transistor is turned off, causing the drive potential generating circuit to produce a high-level output signal.

If the first signal is of logic "0" and the second signal is of logic "0", then both the first thin-film transistor and the second thin-film transistor are turned off, causing the drive potential generating circuit to present a high output impedance.

If both the first thin-film transistor and the second thin-film transistor are of a four-terminal structure separate from a source terminal and having a bias terminal for its semiconductor substrate, then the gate voltages of the thin-film transistors can be controlled based on a fixed potential, i.e., a substrate potential. The thin-film transistors can therefore be designed easily with increased freedom of design.

If the first thin-film transistor and the second thin-film transistor have respective channels of the same conductivity type, then the substrate potentials of the first and second thin-film transistors can be set to one potential which may be equal to the potential of the low-level power supply. consequently, the number of power supply lines can be reduced.

The display device according to the present invention can use materials, such as CdSe or the like, which can be processed to form only n-channel elements, and can use materials which can be processed to form only n-channel enhancement mode FETs.

Preferably, a potential difference between the high-level power supply and the low-level power supply is lower than a maximum voltage which is applied between the electrodes of the capacitive element. This arrangement is free of the withstand voltage problem of the series circuit (the first and second thin-film transistors) connected between the high-level power supply and the low-level power supply, allows the capacitive elements to have a sufficient area (picture element aperture ratio).

The selector circuit may have a series circuit of a third thin-film transistor and a fourth thin-film transistor which are connected between a high-level power supply and a low-level power supply, the series circuit having a common drain connected to the other of the electrodes of the capacitive element.

In this case, a potential difference between the high-level power supply and the low-level power supply is also preferably lower than a maximum voltage which is applied between the electrodes of the capacitive element. This arrangement is free of the withstand voltage problem of the series circuit (the third and fourth thin-film transistors) connected between the high-level power supply and the low-level power supply.

The third thin-film transistor may have a channel of a first conductivity type and the fourth thin-film transistor may have a channel of a second conductivity type. Alternatively, the third thin-film transistor and the fourth thin-film transistor may have respective channels of the same conductivity type.

Each of the selector circuits may be assigned commonly to a row of picture elements of the picture elements. If the display unit has 128 rows of picture elements, then the selector unit has 128 selector circuits.

The display device may further include at first board and a second board, at least the capacitive elements being disposed on the first board, at least the driver unit being disposed on the second board, the first board and the second board being bonded to each other.

With this arrangement, the capacitive elements which are directly involved in the aperture ratio of the picture elements can be formed in an array without taking into account the area in which the drive circuits are formed, and the drive circuits can be formed in an array without taking into account the area in which the capacitive elements are formed.

Accordingly, the aperture ratio of the picture elements can greatly be increased, and the layout of the drive circuits can freely be established, resulting in an increase in the selectivity of circuit components and an increase in the freedom of design. These advantages lead to a reduction in the cost of manufacture of the display device and an ability to fabricate the display device in a wide variety of arrangements depending on modes of use of the display device (environments in which the display device is installed and purposes for which the display device is used).

The second board may have a plurality of interconnection circuit forming areas associated respectively with the drive circuits, each of the interconnection circuit forming areas having a select line extending in a row direction in a region near another one of the interconnection circuit forming areas which is assigned upwardly or downwardly of the each interconnection circuit forming area, a signal line extending in a column direction in a region near another one of the interconnection circuit forming areas which is assigned leftwardly or rightwardly of the each interconnection circuit forming area, and an electrode pad connected to the one of the electrodes of the corresponding capacitive element, the electrode pad and the drive circuit being disposed in a circuit forming region defined by the select line and the signal line.

If the display unit a matrix of picture elements arranged in 128 rows and 128 columns, for example, then the second board has an array of 128×128=16384 interconnection circuit forming areas. In each of the interconnection circuit forming areas, the select line extending in the row direction is disposed in the region near another one of the interconnection circuit forming areas which is assigned upwardly or downwardly of the each interconnection circuit forming area, and the signal line extending in the column direction is disposed in the region near another one of the interconnection circuit forming areas which is assigned leftwardly or rightwardly of the each interconnection circuit forming area. Because the interconnections are assigned to the end regions of each of the interconnection circuit forming areas, a wide region is assigned as the circuit forming region defined by the select line and the signal line.

Consequently, if each drive circuit is constructed as a circuit including a plurality of thin-film transistors, then the freedom about the size and layout of each of the thin-film transistors is increased.

If the drive potential generating circuit has a series circuit of a first thin-film transistor and a second thin-film transistor which are connected between a high-level power supply and a low-level power supply, then each of the interconnection circuit forming areas may further have a high-level power supply line extending in the row direction in a region thereof shared by another one of the interconnection circuit forming areas which is assigned upwardly or downwardly of the each interconnection circuit forming area, and a low-level power supply line extending in the row direction in a region thereof shared by another one of the interconnection circuit forming areas, other than the other of the interconnection circuit forming areas, which is assigned upwardly or downwardly of the each interconnection circuit forming area.

The high-level power supply line, for example, is formed in a boundary region between the interconnection circuit forming area and the other interconnection circuit forming area that is assigned upwardly, for example, of the interconnection circuit forming area, and the low-level power supply line, for example, is formed in a boundary region between the interconnection circuit forming area and the other interconnection circuit forming area that is assigned downwardly, for example, of the interconnection circuit forming area. Thus, it is possible to form the high-level power supply line and the low-level power supply line in every other row, so that the number of the power supply lines can effectively be reduced.

As the power supply lines are formed on the ends of the circuit forming region, any reduction in the area of the circuit forming region due to the presence of the power supply lines is minimized.

If each of the selector circuits is assigned commonly to a row of picture elements of the picture elements, then the second board may have electrode pads disposed in peripheral regions thereof and connected to the selector circuits, respectively, the electrode pads being connected to interconnections extending to ends of the second board.

Thus, the interconnection circuit forming areas can be formed irrespective of the presence of the electrode pads connected to the selector circuits, and the areas of the interconnection circuit forming areas are not reduced by the electrode pads.

Each of the drive circuits may comprise a first logic gate for inhibiting a first signal from being inputted from a first control line included in the signal line when not selected and allowing the first signal to be inputted from the first control line when selected based on a select signal from one of the select lines, and a second logic gate for inhibiting a second signal from being inputted from a second control line included in the signal line when not selected and allowing the second signal to be inputted from the second control line when selected based on the select signal from the select line, wherein for controlling the drive potential generating circuit to translate the output thereof into three states based on first and second signals from the signal line, the first control line may be extended across one end of the second board in the column direction, the second control line may be extended across another end, opposite to the one end, of the second board, and the select line may be extended across an end of the second board in the row direction.

Consequently, the first and second control lines can be extended linearly along the respective columns, and the select lines can be extended linearly along the respective rows. Therefore, any increase in the parasitic inductance and parasitic resistance in each of the interconnections is suppressed, thus suppressing any reduction in the signal transfer efficiency along each of the interconnections. In each of the interconnection circuit forming areas, furthermore, it is possible to form the first and second control lines which extend along the columns, and the select lines which extend along the rows.

The first control line, the second control line, and the select line may be extended across the corresponding ends of the second board to a reverse surface of the second board by end face printing. The interconnections of these lines may be connected to joints of cables or connectors that are connected to a circuit at a higher level, for example. In a large-size display device which is made up of a number of display elements, the gaps at the junctions between the display elements are so minimized that the joints between the display elements are made visually less distinctive for displaying images of increased quality.

If the drive potential generating circuit has a series circuit of a first thin-film transistor and a second thin-film transistor which are connected between a high-level power supply and a low-level power supply, then the high-level power supply may have at least one first lead-in line extending in the column direction from one of the ends of the second board, and a plurality of branch lines branched from the first lead-in line along odd-numbered rows or even-numbered rows, and the low-level power supply may have at least one second lead-in line extending in the column direction from one of the ends of the second board, and a plurality of branch lines branched from the second lead-in line along rows which are different from the rows along which the first branch lines are branched.

For example, if the high-level power supply and the low-level power supply are extended toward each of the interconnection circuit forming areas, then it may be proposed to extend the high-level power supply and the low-level power supply along each of the rows, i.e., two power supply lines extended along one row.

According to the present invention, however, the branch lines (first branch lines) of the high-level power supply line are extended along odd-numbered rows or even-numbered rows, and the branch lines (second branch lines) of the low-level power supply line are extended along rows which are different from the rows along which the first branch lines are branched. Therefore, a single power supply line is extended along one row, so that the number of power supply lines can greatly be reduced. This leads to minimizing any reduction in the area of the circuit forming region in each of the interconnection circuit forming areas.

Since lead-in interconnections from external sources to the high-level power supply line and the low level power supply line are provided by the respective first and second lead-in lines, interconnections for introducing power supply lines can be provided without obstructing the interconnections of the first and second control lines which are extended along the respective columns.

At least the first lead in line and the second lead in line may be extended across the corresponding ends of the second board to a reverse surface of the second board by end face printing. The interconnections extending from the electrode pads may be extended across the ends of the second board to a reverse surface of the second board by end face printing.

The interconnections extending to the reverse surface of the second board may be connected to joints of cables or connectors that are connected to a circuit at a higher level, for example.

With the above arrangement, in a large-size display device which is made up of a number of a number of display elements, the gaps at the junctions between the display elements are so minimized that the joints between the display elements are made visually less distinctive for displaying images of increased quality.

For example, an actuator, a liquid crystal cell, a PDP cell, etc. can be used for the capacitive element.

The above and other objects, features, and advantages of the present invention will become more apparent from the following description when taken in conjunction with the accompanying drawings in which preferred embodiments of the present invention are shown by way of illustrative example.

BRIEF DESCRIPTION OF THE DRAWINGS

F1G. 1 is a perspective view of a display device according to an embodiment of the present invention.

DESCRIPTION OF THE PREFERRED EMBODIMENTS

Embodiments of display devices according to the present invention will be described below with reference to FIGS. 1 to 21.

Figure 1:
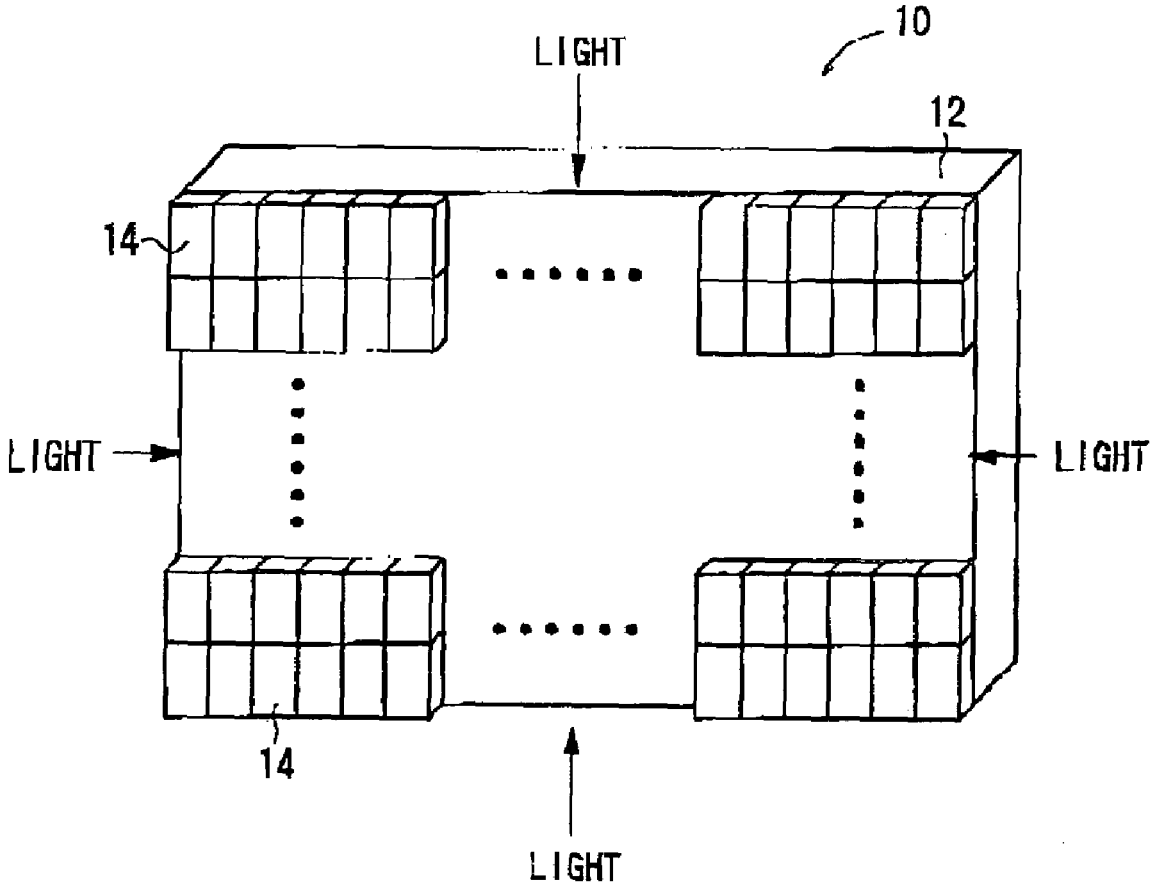

As shown in FIG. 1, a display device 10 according to an embodiment of the present invention comprises a light guide panel 12 having a display area for the display device 10 and a plurality of display elements 14 mounted as a matrix on a rear surface of the light guide panel 12.

Figure 2:
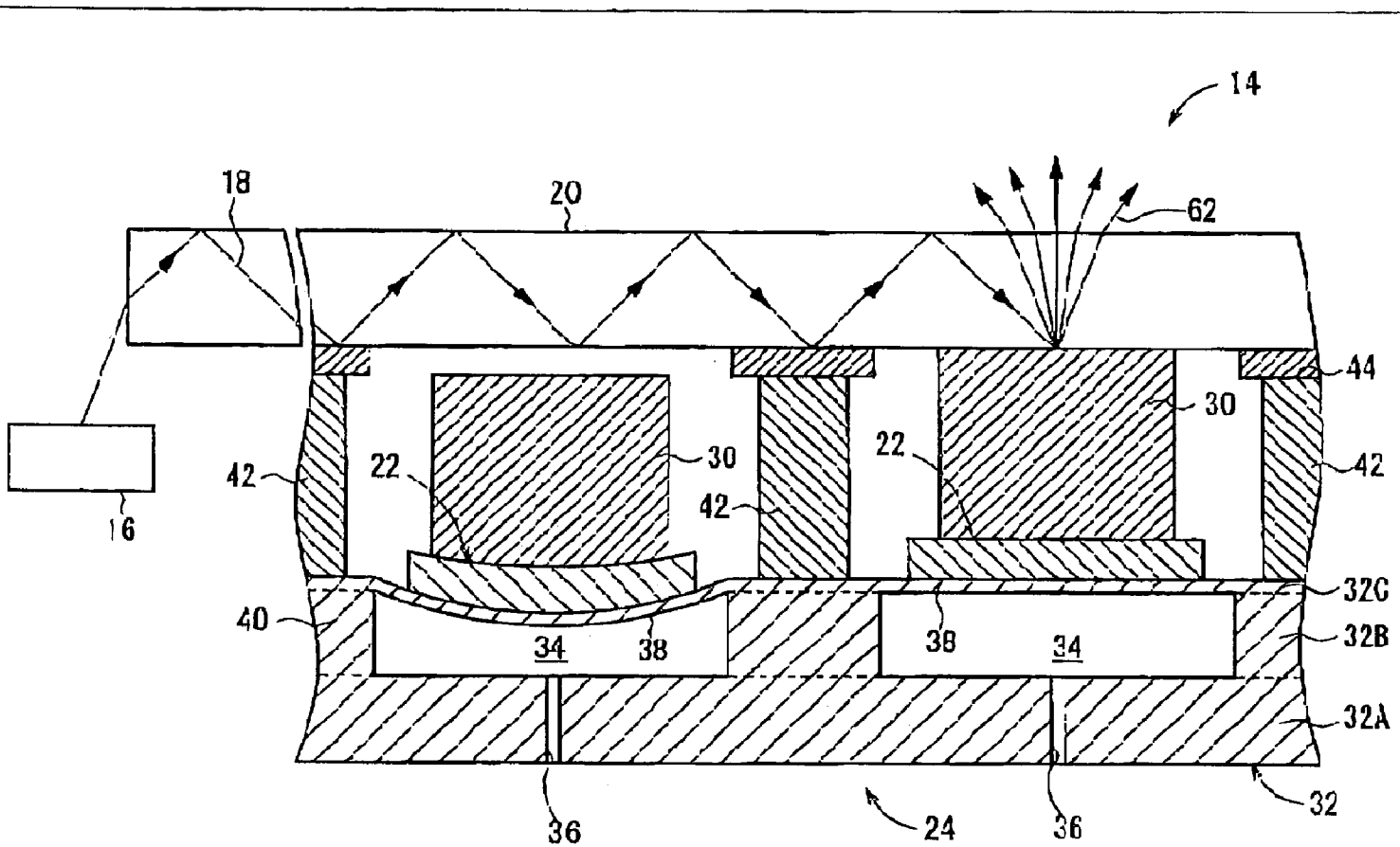
FIG. 2 is a fragmentary cross-sectional view of a display element.

As shown in FIG. 2, each of the display elements 14 comprises an optical waveguide plate 20 into which light 18 emitted from a light source 16 is introduced, and a display unit 24 disposed in confronting relation to a rear surface of the optical waveguide plate 20 and having a matrix or staggered array of capacitive elements 22 aligned with respective picture elements. This embodiment is the example which applied the capacitive element 22 to the actuator. Therefore, the following explanation describes "the capacitive element 22" "the actuator 22."

Figure 3A:
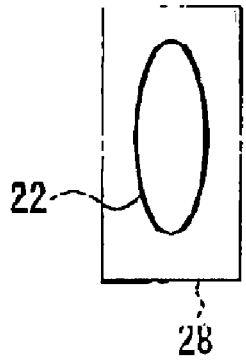
FIG. 3A is a view illustrative of a picture element array for displaying a monochromatic image, the picture element array being capable of also displaying a color image.
Figure 3B:
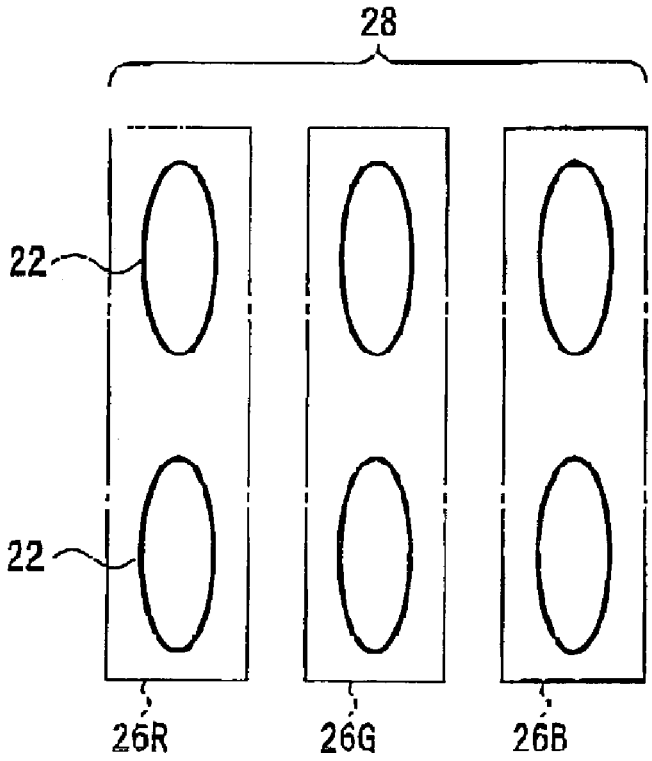
FIG. 3B is a view illustrative of a picture element array for displaying a color image.

As shown in FIG. 3A, a single actuator 22 may make up a single picture element 28. Alternatively, as shown in FIG. 3B, two actuators 22 may make up a single dot, and three dots including a red dot 26R, a green dot 26G, and a blue dot 26B may make up a single picture element 28. The a picture element array shown in FIG. 3A is a picture element array for displaying a monochromatic image. The picture elements 28 of the display elements 14 shown in FIG. 2 are arranged in horizontal rows each containing 128 picture elements 28 and vertical columns each containing 128 picture elements 28 according to the picture element array shown in FIG. 3A.

As shown in FIG. 1, the display elements 14 of the display device 10 are arranged on the rear surface of the light guide panel 12 in horizontal rows each containing 5 display elements 14 and vertical columns each containing 4 display elements 14, so that 640 picture elements (1920 dots) are arrayed horizontally and 480 picture elements (480 dots) are arrayed vertically according to VGA (Video Graphics Array) standards.

The light guide panel 12 comprises a panel such as a glass panel, an acrylic panel, or the like whose light transmittance in the visible light wavelength range is large and uniform. The display elements 14 are connected by wire bonding or soldering using end connectors, rear connectors, or the like, so that they can be supplied with necessary signals through connections therebetween.

The light guide panel 12 and the optical waveguide plate 20 of the display elements 14 should preferably be made of materials having similar refractive indexes. The light guide panel 12 and the optical waveguide plate 20 may be bonded to each other by a transparent adhesive or liquid that should preferably have a high and uniform light transmittance in the visible light wavelength range, as with the light guide panel 12 and the optical waveguide plate 20. The refractive index of the transparent adhesive or liquid should preferably be close to the refractive indexes of the light guide panel 12 and the optical waveguide plate 20 for achieving a desired level of brightness on the display screen of the display device 10.

As shown in FIG. 2, each display element 14 also includes picture element assemblies 30 disposed respectively on the actuators 22.

The display unit 24 has an actuator substrate 32 made of ceramics, for example, with the actuators 22 disposed on the actuator substrate 32 at respective positions corresponding to the picture elements 28. The actuator substrate 32 has one continuous flat principal surface facing the rear surface of the optical waveguide plate 20. The actuator substrate 32 has a plurality of hollow spaces 34 defined in the respective positions corresponding to the picture elements 28 and serving part of vibrating sections (described below). The hollow spaces 34 communicate with the space around the display element 14 via small-diameter through holes 36 which are defined in the opposite surface of the actuator substrate 32.

The actuator substrate 32 includes thin-wall portions lying over the respective hollow spaces 34 and thick-wall portions extending between the thin-wall portions. The thin-wall portions function as vibrating sections 38 which can easily be vibrated under external stresses applied thereto. The thick-wall portions function as fixed sections 40 supporting the vibrating sections 38 therebetween over the hollow spaces 34.

The actuator substrate 32 thus constructed may be regarded as a unitary stacked structural body having a lowermost substrate layer 32A, an intermediate spacer layer 32D, and an uppermost thin layer 32C, with the hollow spaces 34 defined in the spacer layer 32B in alignment with the respective actuators 22. The substrate layer 32A functions as both a stiffening board and a wiring board. The actuator substrate 32 may be of an integrally sintered structure or may be made up of separate layers which are combined together.

The substrate layer 32A, the spacer layer 32B, and the thin layer 32C should preferably be made of a material which is highly heat-resistant, highly strong, and highly tough, such as stabilized zirconium oxide, partially stabilized zirconium oxide, aluminum oxide, magnesium oxide, titanium oxide, spincl, mullite, or the like. The substrate layer 32A, the spacer layer 32B, and the thin layer 32C may be made of one material or different materials, respectively.

The thickness of the thin layer 32C is usually of 50 $\mu$m or smaller, and preferably in the range from 3 to 20 $\mu$m, in order to allow the actuator 22 to be displaced greatly.

Figure 4:
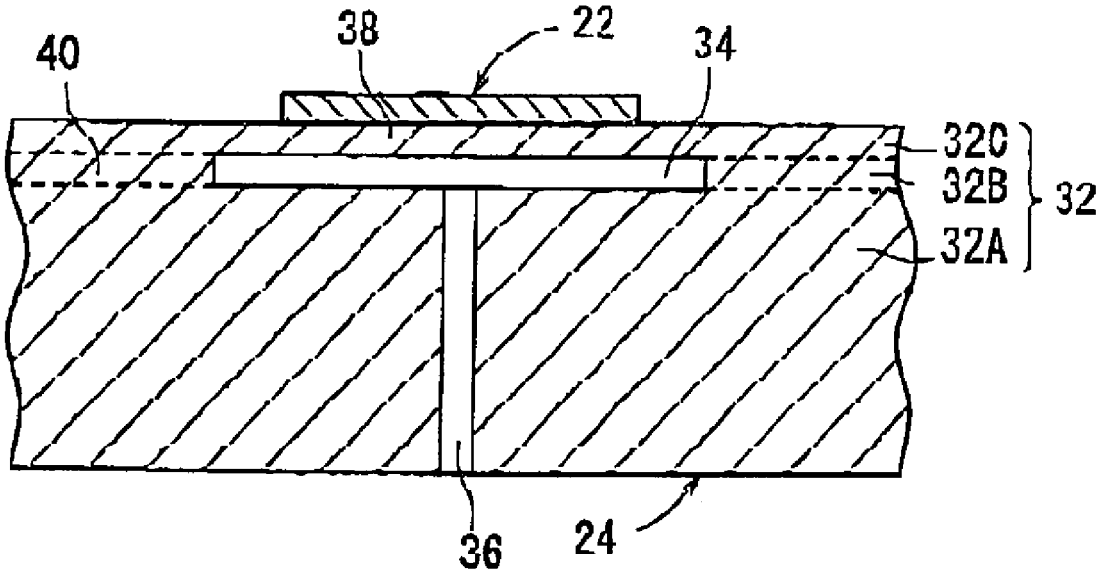
FIG. 4 is a fragmentary cross-sectional view of a display element with a thin spacer layer.

The spacer layer 32B may be present only for providing the hollow spaces 34 in the actuator substrate 32, and is not limited to any particular thickness. The thickness of the spacer layer 32B may be determined depending on the purpose of the hollow spaces 34. The spacer layer 32B should preferably be thin, as shown in FIG. 4, so that it does not have a thickness greater than necessary for the actuators 22 to function. For example, the thickness of the spacer layer 32B in preferably commensurate with the magnitude of the displacement of the actuators 22.

With the above arrangement, the flexing of the thin-wall portions (the vibrating sections 38) is limited by the substrate layer 32A which is positioned closely thereto in the direction in which the thin-wall portions are flexible. Therefore, the thin wall portions are prevented from being broken under unexpected external forces. It is possible to stabilize the displacement of the actuators 22 to a certain value based on the ability of the substrate layer 32A to limit the flexing of the thin-wall portions.

With the spacer layer 32B being thin, the thickness of the actuator substrate 32 may be reduced and its flexural rigidity may be reduced. In bonding and fixing the actuator substrate 32 to another member (e.g., the optical waveguide plate 20), for example, the actuator substrate 32 is effectively corrected out of its warpage with respect to the optical waveguide plate 20. Therefore, the actuator substrate 32 can be bonded and fixed with increased reliability.

Since the actuator substrate 32 is thin as a whole, the amount of stock can be reduced in the manufacture of the actuator substrate 32. Thus, the actuator substrate 32 is of an advantageous structure from the standpoint of the manufacturing cost. Specifically, the thickness of the actuator substrate 32 should preferably be in the range from 3 to 50 $\mu$m and more preferably be in the range from 3 to 20 $\mu$m.

As the spacer layer 32B is thin, the thickness of the substrate layer 32A is generally of 50 $\mu$m or more and preferably is in the range from 80 to 300 $\mu$m for the purpose of stiffening the actuator substrate 32 in its entirety.

Figure 5:
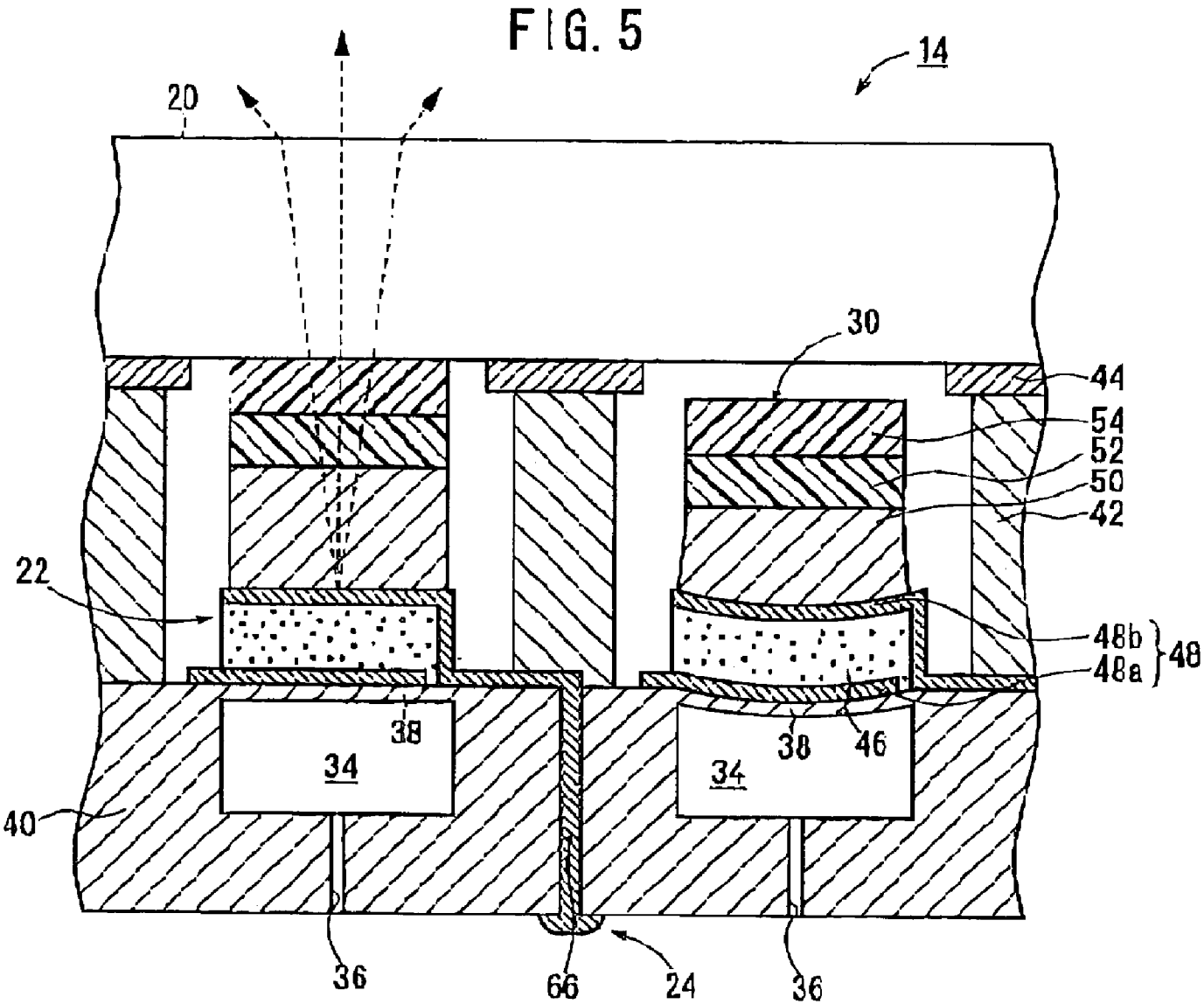
FIG. 5 is a fragmentary cross-sectional view of a specific structure of an actuator and a picture element assembly.

A specific example of the actuator 22 and the picture element assembly 30 will be described below with reference to FIG. 5. In FIG. 5, light shielding layers 44 are disposed between crosspieces 42, which are made of a material that is resistant to deformation under forces, and the optical waveguide plate 20.

As shown in FIG. 5, the actuator 22 has, in addition to the vibrating section 38 and the fixed section 40, a piezoelectric/electrostrictive layer 46 formed directly on the vibrating section 38, and a pair of electrodes 48 disposed respectively on upper and lower surfaces of the piezoelectric/electrostrictive layer 46. The electrodes 48 comprise a lower electrode 48*a* and an upper electrode 48*b*.

The electrodes 48 may be disposed on the upper and lower surfaces and one side of the piezoelectric/electrostrictive layer 46, as shown in FIG. 5, or may be disposed on only the upper surface of the piezoelectric/electrostrictive layer 46.

If the electrodes 48 are disposed on only the upper surface of the piezoelectric/electrostrictive layer 46, then the electrodes 48 may comprise comb-shaped teeth disposed in an interdigitating relation to each other, or may be of a spiral shape or a multi-branch shape as disclosed in Japanese laid-open patent publication No. 10-78549.

Figure 6:
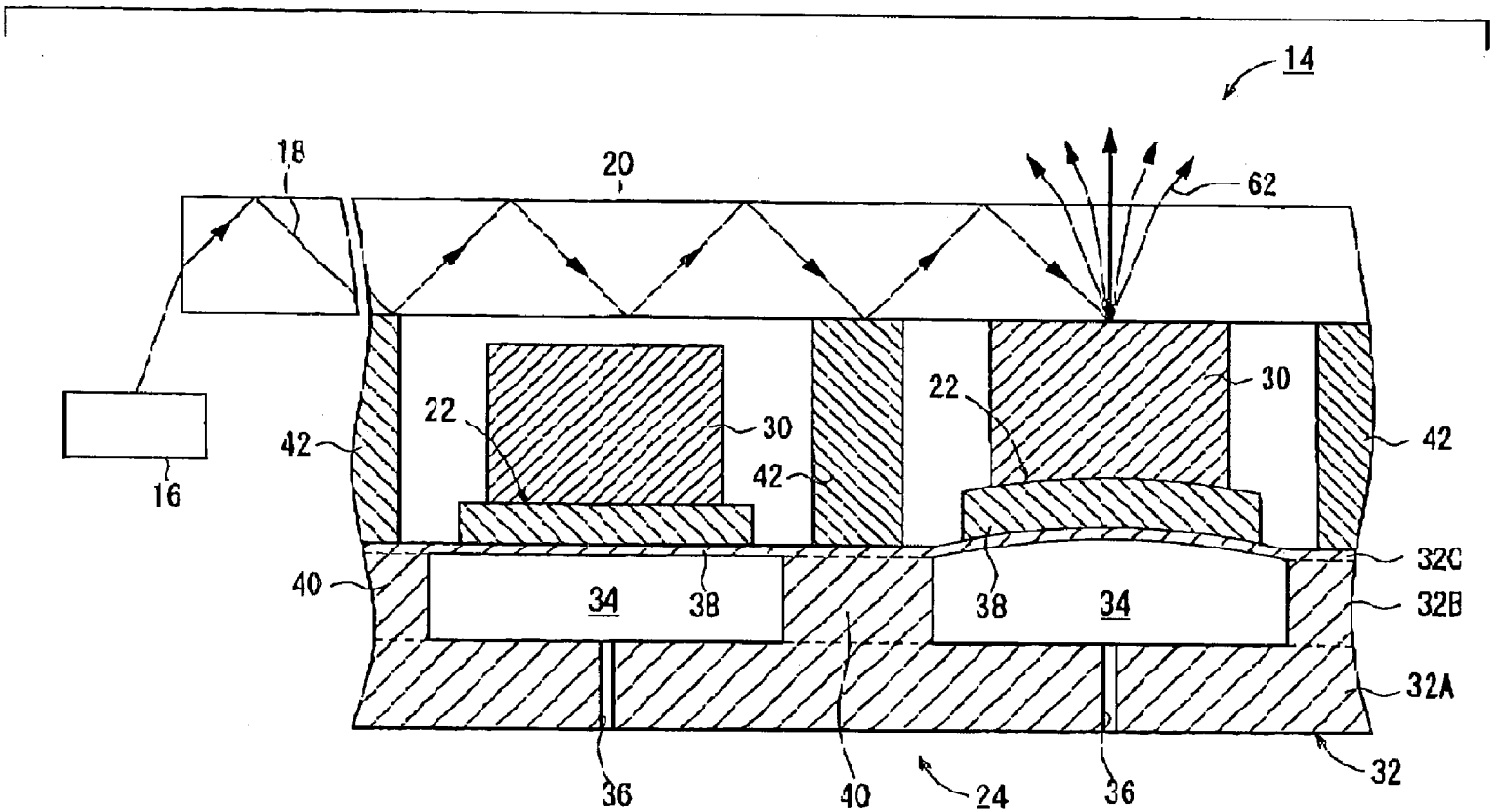
FIG. 6 is a fragmentary cross-sectional view of another arrangement of a display element.

If the lower electrode 48*a* is disposed on the lower surface of the piezoelectric/electrostrictive layer 46 and the upper electrode 48*b* is disposed on the upper surface of the piezoelectric/electrostrictive layer 46, as shown in FIG. 5, then the actuator 22 may be flexibly displaced in one direction so as to be convex toward the recess 34, as shown in FIGS. 2 and 5. Alternatively, the actuator 22 may be flexibly displaced so as to be convex toward the optical waveguide plate 20, as shown in FIG. 6. In the example shown in FIG. 6, the light shielding layers 44 (see FIG. 2) are not included.

If the picture element array is such that a red dot 26R, a green dot 26G, and a blue dot 26B make up a single picture element 28, as shown in FIG. 3B, then, as shown in FIG. 5, the picture element assembly 30 may be constructed as a stacked body disposed as a displacement transfer element on the actuator 22 and comprising a white scattering body 50, a color filter 52, and a transparent layer 54. If the picture element array is such that a single actuator 22 makes up a single picture element 28, as shown in FIG. 3A, then the picture element assembly 30 may be constructed as a stacked body which is similar to the stacked body shown in FIG. 5 except that the color filter 52 is dispensed with.

The above stacked body may be modified as follows: (1) The white scattering body 50 is replaced with a light reflecting layer and an insulating layer which are laminated together. (2) The displacement transfer element disposed as the picture element assembly 30 on the actuator 22 comprises a stacked body of a colored scattering body and a transparent layer. (3) The displacement transfer element comprises a stacked body of a transparent layer, a colored scattering body, a light reflecting layer, and an insulating layer.

As shown in FIGS. 2, 5, and 6, the crosspieces 42 are disposed between the optical waveguide plate 20 and the actuator substrate 32 and positioned around the picture element assemblies 30. In the example shown in FIG. 6, the optical waveguide plate 20 is directly fixed to the upper surfaces of the crosspieces 42. The crosspieces 42 should preferably be made of a material which is resistant to deformation when subjected to heat and pressure.

Operation of the display device 10 will briefly be described below with reference to FIGS. 2 and 5. Light 18 is introduced into the optical waveguide plate 20 from an end thereof, for example. The optical waveguide plate 20 has its refractive index pre-adjusted to cause all the light 18 to be totally reflected within the optical waveguide plate 20 without passing through front and rear surfaces thereof while the picture element assemblies 30 are not in contact with the optical waveguide plate 20. The refractive index n of the optical waveguide plate 20 is preferably in the range from 1.3 to 1.8, and more preferably from 1.4 to 1.7.

In the present embodiment, while the actuators 22 are in their free state, since the end faces of the picture element assemblies 30 are held in contact with the rear surface of the optical waveguide plate 20 by a distance equal to or smaller than the wavelength of the light 18, the light 18 is reflected by the end faces of the picture element assemblies 30 and becomes scattered light 62. The scattered light 62 is partly reflected in the optical waveguide plate 20, but mostly passes through the front surface of the optical waveguide plate 20 without being reflected herein. All the actuators 22 are in the on state, emitting light in a color corresponding to the color of the color filters 52 and the colored scattering bodies 50 in the picture element assemblies 30. Because all the actuators 22 are in the on state, a white color is displayed on the display screen of the display device 10.

When the low level voltage of −10 V is applied as a drive voltage between the upper electrodes 48*b* and the lower electrodes 48*a* of the actuators 22, the end faces of the picture element assemblies 30 are brought into contact with the rear surface of the optical waveguide plate 20, holding the actuators 22 more reliably in the on state for stable display.

When the high-level drive voltage (50 V) is applied between the upper electrode 48*b* and the lower electrode 48*a* of the actuator 22 corresponding to a certain dot 26, the actuator 22 in flexibly displaced so as to be convex toward the hollow space 34, i.e., downwardly, spacing the end face of the picture element assembly 30 away from the optical waveguide plate 20, as shown in FIG. 2. The picture element corresponding to the actuator 22 is now turned off, extinguishing the light which has been emitted thereby.

Therefore, the display element 14 controls light emission (scattered light 62) on the front surface of the optical waveguide plate 20 depending on whether the picture element assemblies 30 contact the optical waveguide plate 20 or not.

Figure 7:
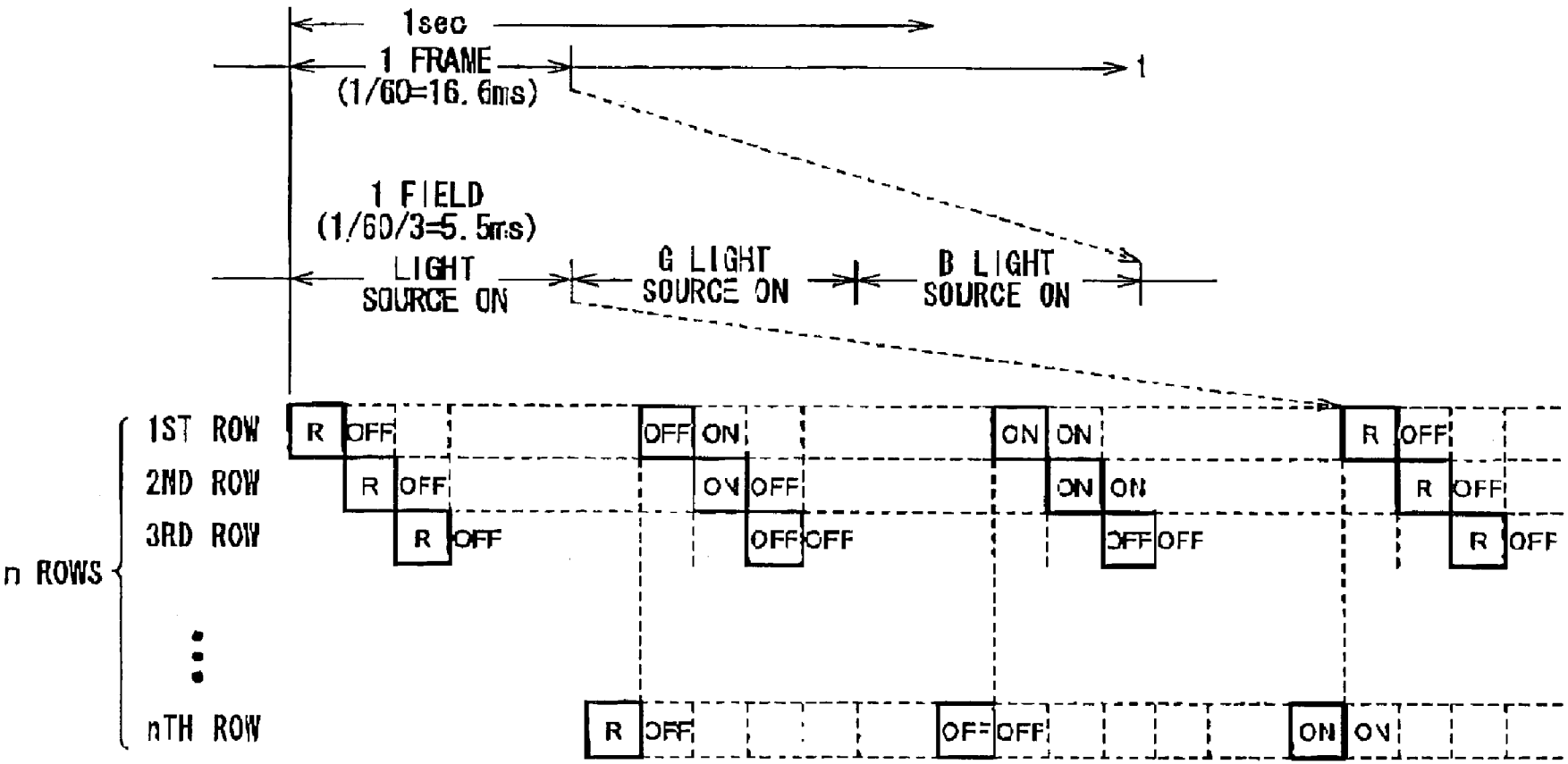
FIG. 7 is a diagram showing details of one frame and one field.

As shown in FIG. 7, one frame (1/60 sec.) of an image signal is divided into three time zones (first to third fields), and three color light sources are switched into and out of operation successively in those time zones. For example, light from a red light source (R light source) is introduced in the first field, light from a green light source (G light source) is introduced in the second field, and light from a blue light source (B light source) is introduced in the third field, for thereby displaying a color image even with the monochromatic picture element array. A high resolution can be achieved because a single actuator 22 makes up a single picture element 28.

Figure 8:
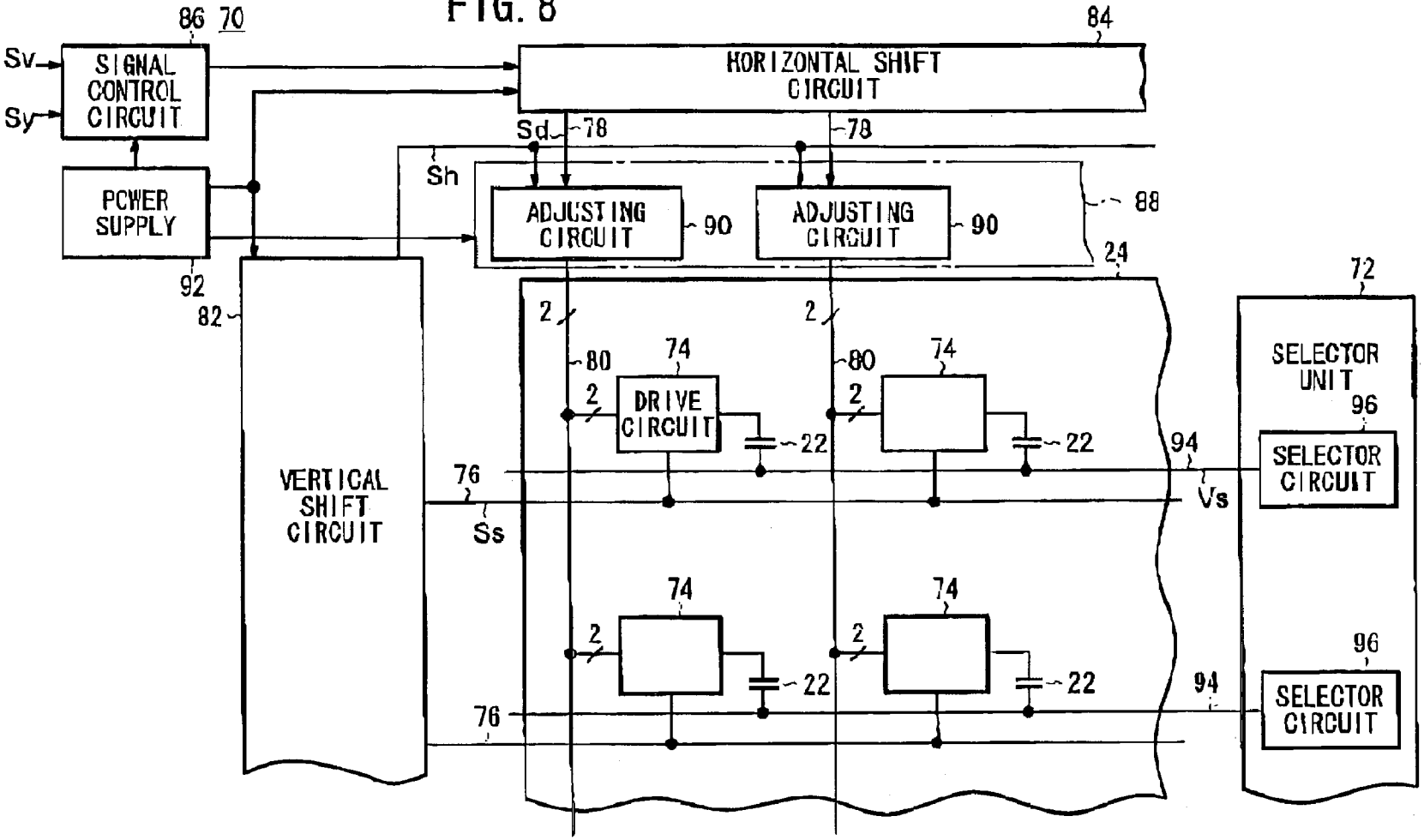
FIG. 8 is a block diagram of a drive unit and a selector unit according to the embodiment of the present invention.

As shown in FIG. 8, each of the display elements 14 has a drive unit 70 and a selector unit 72.

The drive unit 70 comprises a plurality of drive circuits 74 arrayed in association with the respective picture elements (actuators 22) of the display unit 24, for applying a drive potential Vd to the upper electrodes 48*b* (see FIG. 5) of the corresponding actuators 22 to drive the actuators 22, as many first row select lines 76 as the number of rows of picture elements (actuators 22), as many picture element signal lines 78 as the number of columns of picture elements, and control signal lines 80 corresponding to the picture element signal lines 78, with two control signal lines 80 assigned to each picture element signal line 78.

The drive unit 70 also has a vertical shift circuit 82, a horizontal shift circuit 84, a signal control circuit 86, and a signal line control circuit 88.

The vertical shift circuit 82 selectively supplies drive signals Ss to the first row select lines 76 for successively selecting the actuators 22 in one row at a time. The vertical shift circuit 82 outputs a synchronizing signal Sh in timed relation to the selection of a row. The horizontal shift circuit 84 outputs parallel picture element signals Sd to the picture element signal lines 78. The signal control circuit 86 controls the vertical shift circuit 82 and the horizontal shift circuit 84 based on a video signal Sv and a synchronizing signal Sy which are inputted to the signal control circuit 86. The signal line control circuit 88 has as many adjusting circuits 90 as the number of columns of picture elements.

Figure 14:
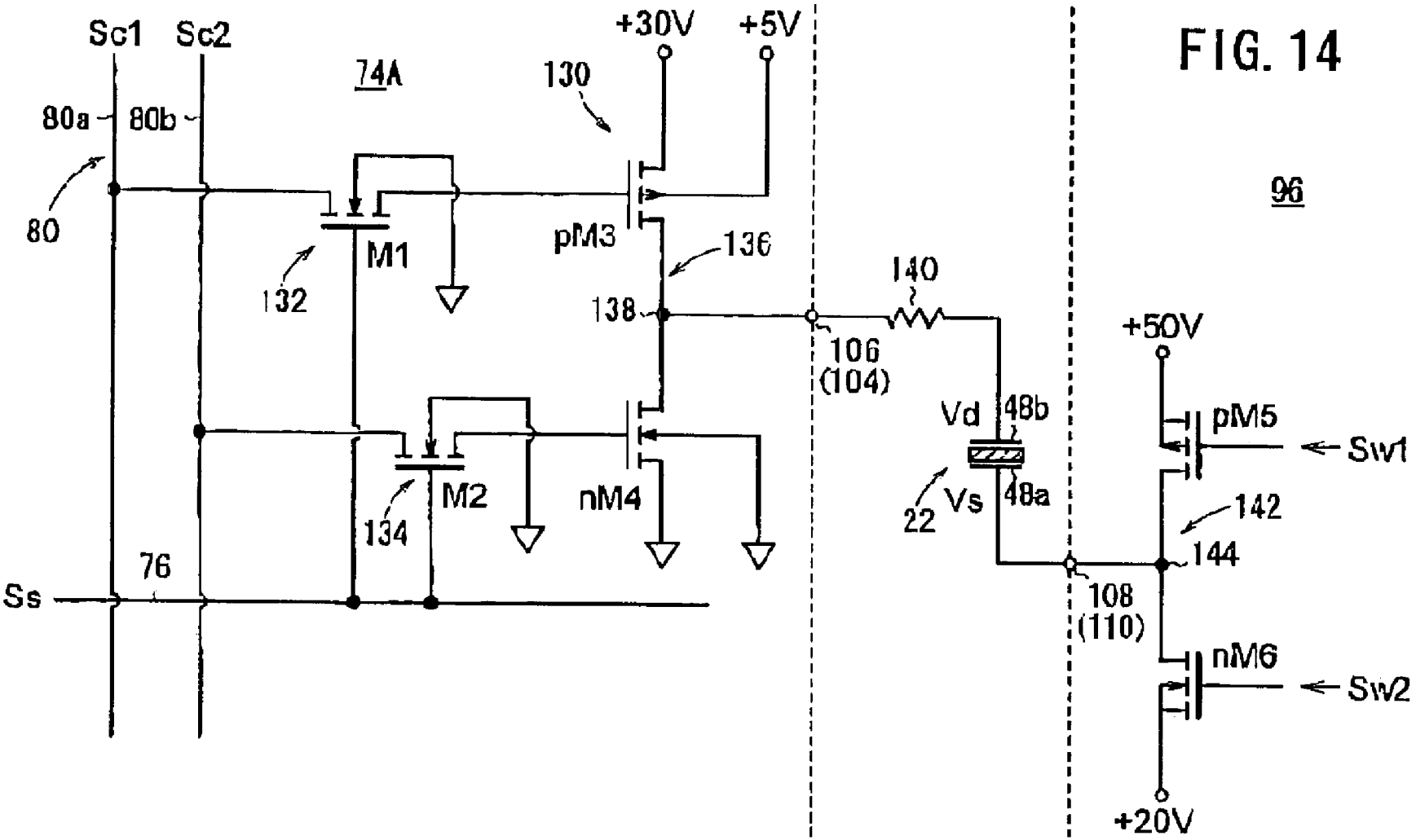
FIG. 14 is a circuit diagram of a drive circuit and a selector circuit according to a first specific example.

Each of the adjusting circuits 90 generates a first control signal Sc1 and a second control signal Sc2, as shown in FIG. 14, based on the attribute of a picture element signal Sd supplied through the corresponding picture element signal line 78, and outputs the first control signal Sc1 and the second control signal Sc2 respectively to a first control line 80*a* and a second control line 80*b*. Examples of the waveform of the picture element signal Sd, the first control signal Sc1, the second control signal Sc2, and a voltage applied to the actuators 22 will be described later on.

Examples of the waveforms of a select signal Ss, the synchronizing signal Sh, the picture element signal Sd, the first control signal Sc1, and the second control signal Sc2 will be described below with reference to FIG. 9.

Figure 9:
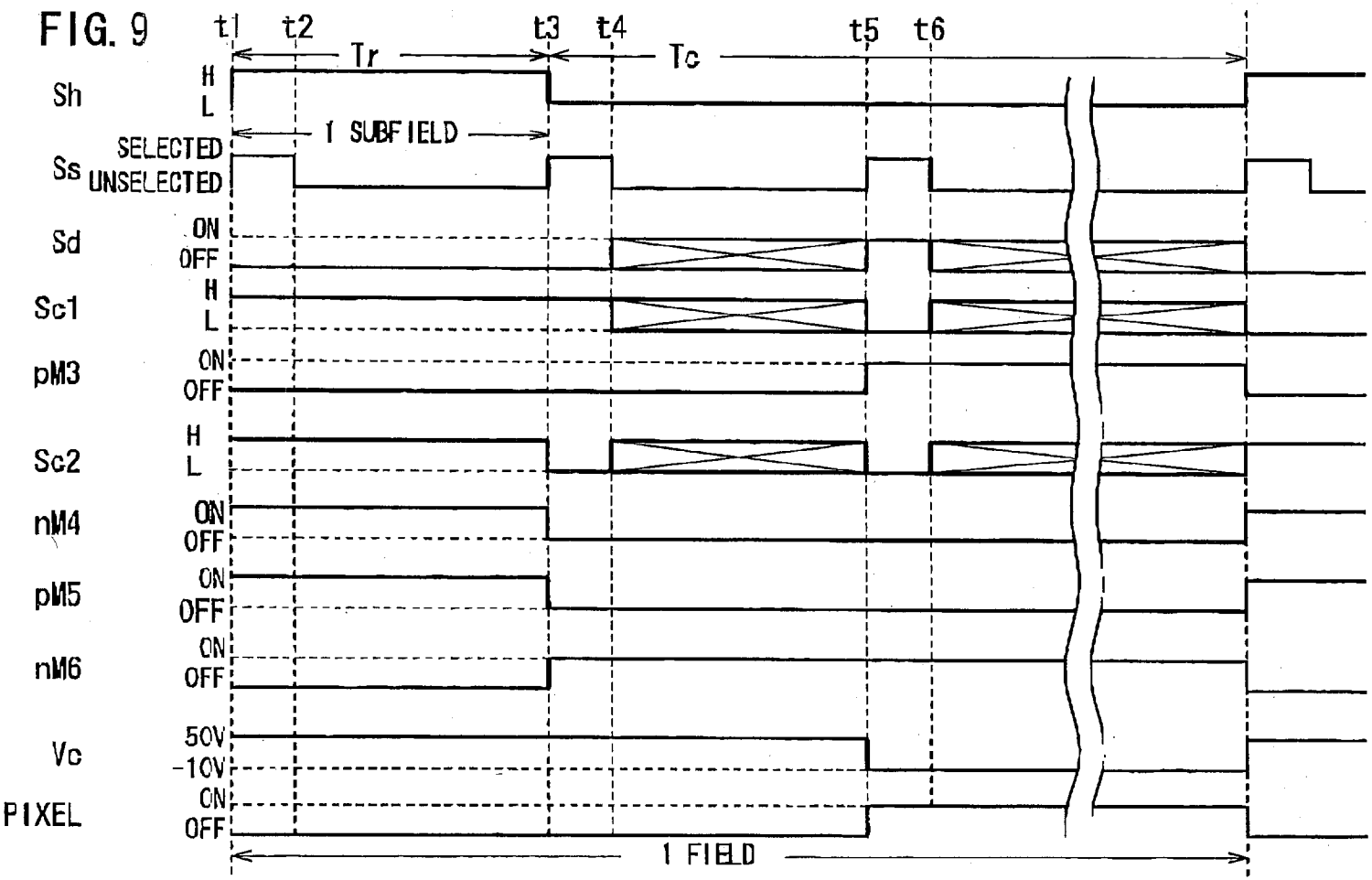
FIG. 9 is a timing chart showing the waveforms of a synchronizing signal, a select signal, a picture element signal, a first control signal, a second control signal, and a drive voltage applied to an actuator, and the on/off states of a power TFT (pM3), a power TFT (nM4), a power TFT (pM5), a power TFT (nM6), and a picture element.

If it is assumed that a period in which all rows are selected by the vertical shift circuit 82 is referred to as a one subfield, then the synchronizing signal Sh has a signal waveform which, as shown in FIG. 9, has a positive-going edge at the start (time t1) of one field and a negative-going edge at the end (time t2) of a first subfield in the period of that field.

The first control signal Sc1 and the second control signal Sc2 have respective levels that vary depending on the levels of the synchronizing signal Sh and the picture element signal Sd. A period in which the synchronizing signal Sh is of a high level is a reset period Tr in which all the picture elements are turned off (extinguished). A period in which the synchronizing signal Sh is of a low level is a gradation expressing period Tc. In the gradation expressing period Tc, the picture element in the first row and the first column, for example, is turned on for the period of a number of subfields depending the gradation level represented by the picture element signal Sd for that period.

In the period in which the synchronizing signal Sh is of a high level (reset period Tr), the attribute of the picture element signal Sd represents a turned-off state (low level), and the first control signal Sc1 and the second control signal Sc2 are of a high level.

In the period in which the synchronizing signal Sh is of a low level (gradation expressing period Tc), if the attribute of the picture element signal Sd represents a turned-off state (low level), then the first control signal Sc1 is of a high level, and the second control signal Sc2 is of a low level (see time t3).

In the period in which the synchronizing signal Sh is of a low level (gradation expressing period Tc), if the attribute of the picture element signal Sd represents a turned-on state (high level), then the first control signal Sc1 is of a low level, and the second control signal Sc2 is of a low level (see time t5).

The vertical shift circuit 82, the horizontal shift circuit 84, the signal control circuit 86, and the signal line control circuit 88 are supplied with a power supply voltage from a power supply 92 (see FIG. 8).

Specific examples of the drive circuit 76 will be described later on.

As shown in FIG. 8, the selector unit 72 has as many second row select lines 94 as the number of rows of the display unit 24, and selector circuits 96 connected respectively to the second row select lines 94. The selector unit 72 applies a select potential Vs to the lower electrodes 48*a* of the actuators 22 which correspond to a row selected by the vertical shift circuit 82, from the selector circuit 96 associated with the selected row through the second row select line 94 connected to the selector circuit 96. Details of the selector circuits 96 will be described later on.

The packaging of the drive unit 70 and the selector unit 72 will be described below. For packaging the drive unit 70 on the display element 14, it may be mounted on the surface of the actuator substrate 32 on which the actuators 22 are disposed. However, such a packaging design possibly fails to provide a sufficient area for the actuators 22 on the actuator substrate 32 which are directly involved in the aperture ratio of the picture elements. If the drive unit 70 is to be installed on the surface of the actuator substrate 32 which is free of the actuators 22, then it is difficult for the actuator substrate 32 to provide a required installation space for the drive unit 70, and the packaging process is complex, tending to result in a reduction in the yield of the actuator substrate 32.

Figure 10:
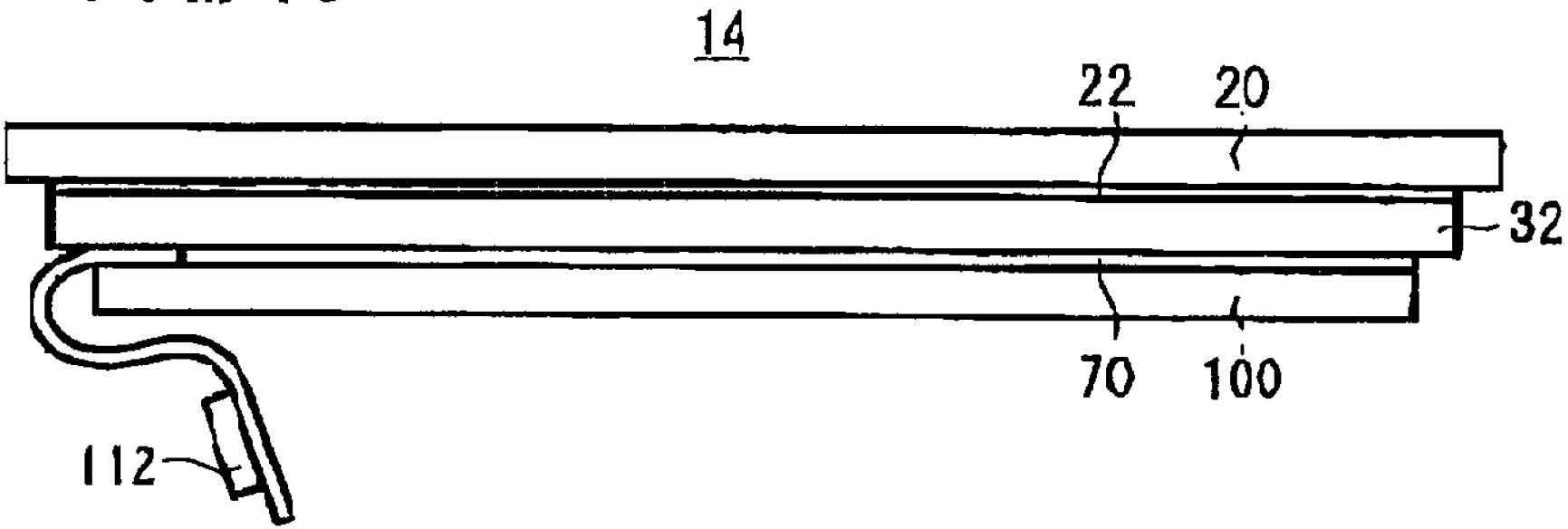
FIG. 10 is a plan view of a display element according to the embodiment of the present invention.

According to the present embodiment, as shown in FIG. 10, a matrix of actuators 22 associated with respective picture elements is formed on the actuator substrate 32, and the drive unit 70 is fabricated on a separate circuit board 100. The light waveguide panel 20 and the actuator substrate 32 are bonded to each other, and the circuit board 100 is bonded to the reverse side of the actuator substrate 32.

Figure 11:
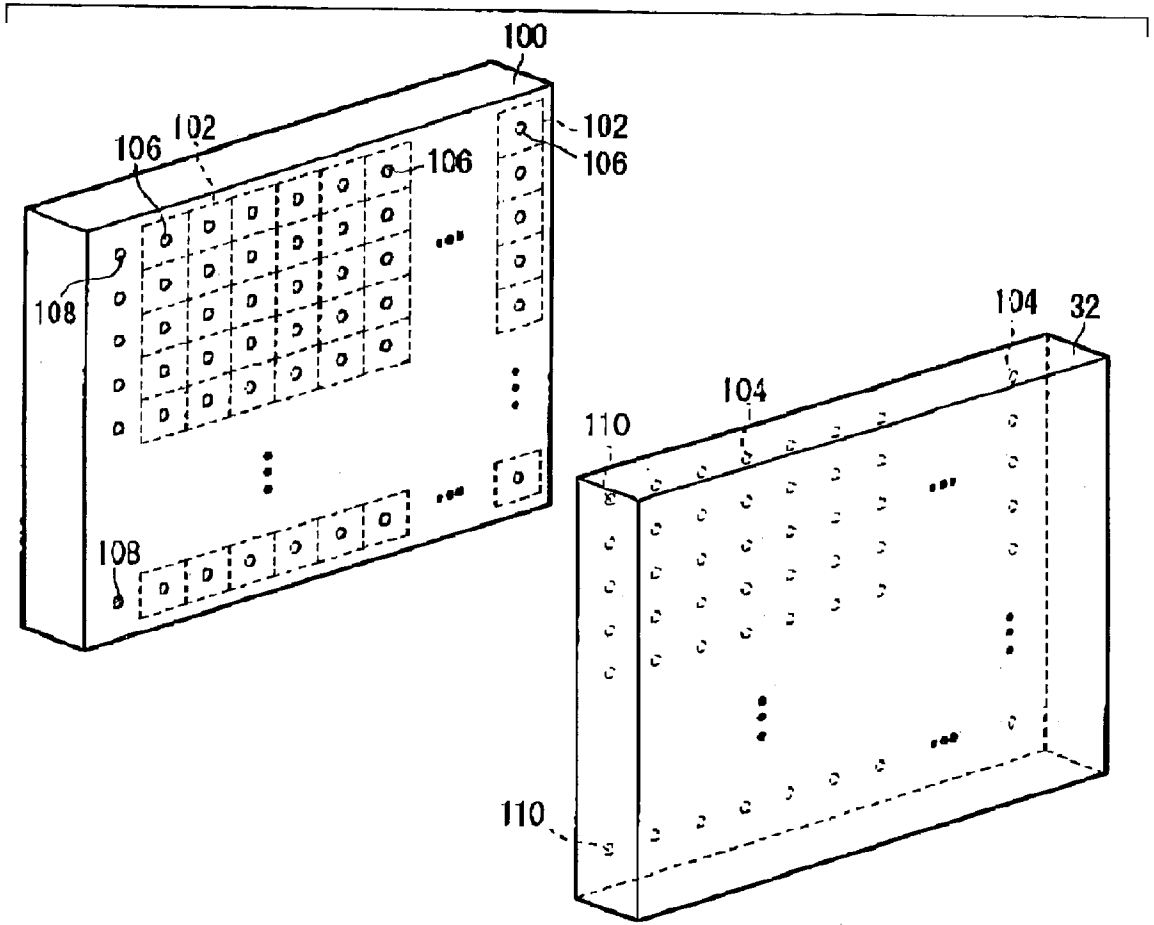
FIG. 11 is an exploded perspective view showing an actuator substrate and a circuit board among the components of the display element according to the embodiment of the present invention.

Specifically, as shown in FIG. 11, the circuit board 100 having areas 102 with drive circuits 74 arrayed on a principal surface thereof (interconnection circuit forming areas 102) is prepared in addition to the actuator substrate 32 with a number of actuators 22 (see FIG. 10) arrayed on a principal surface thereof. A number of through holes 66 (see FIG. 5) are defined in the actuator substrate 32 in alignment with the respective actuators 22, the through holes 66 extending from one principal surface to the other of the actuator substrate 32. Electrode pads 14 are formed on the other principal surface of the actuator substrate 32 in alignment with the respective through holes 66. Therefore, the electrode pads 104 are positioned in alignment with the respective actuators 22 which are disposed on the one principal surface of the actuator substrate 32.

The circuit board 100 has electrode pads 106 of the respective drive circuits 74 (see FIG. 8) which are positioned in alignment with the respective electrode pads 104 when the circuit board 100 is bonded to the reverse side of the actuator substrate 32. The electrode pads 104 and the electrode pads 106 are electrically connected to each other, thus electrically connecting the drive circuits 74 on the circuit board 100 to the respective actuators 22 on the actuator substrate 32.

The selector unit 72 has as many electrode pads 108 as the number of rows, disposed on a peripheral edge (left edge in FIG. 11) of the circuit board 100. The actuator substrate 32 bas electrode pads 110 disposed on the other principal surface thereof in alignment with the respective electrode pads 108. The actuator substrate 32 also has through holes (not shown) defined therein which extend from the electrode pads 110 to the one principal surface thereof.

The actuator substrate 32 and the circuit board 100 are bonded to each other by mating the reverse side of the actuator substrate 32 (on which the electrode pads 104, 110 are formed) with the one principal surface of the circuit board 100, and joining the electrode pads 104 on the actuator substrate 32 and the electrode pads 110 on the circuit board 100 to each other by a solder or an electrically conductive resin, for example. With the actuator substrate 32 and the circuit board 100 being thus bonded to each other, one of the electrodes (e.g., the upper electrode 49*b*) of each of the actuators 22 and the output terminal of the corresponding drive circuit 72 are electrically connected to each other.

With this arrangement, the actuators 22 which are directly involved in the aperture ratio of the picture elements can be formed in an array without taking into account the area in which the drive circuits 74 are formed, and the drive circuits 74 can be formed in an array without taking into account the area in which the actuators 22 are formed.

Accordingly, the aperture ratio of the picture elements can greatly be increased, and the layout of the drive circuits 74 can freely be established, resulting in an increase in the selectivity of circuit components and an increase in the freedom of design. These advantages lead to a reduction in the cost of manufacture of the display device 10 and an ability to fabricate the display device 10 in a wide variety of arrangements depending on modes of use of the display device 10 (environments in which the display device 10 is installed and purposes for which the display device 10 is used).

In the present embodiment, furthermore, the first row select lines 76, the first control lines 80*a*, and the second control lines 80*b*, in addition to the drive circuits 74, are formed on the one principal surface of the circuit board 100.

When the first row select lines 76, the first control lines 80*a*, and the second control lines 80*b* are to be formed on the actuator substrate 32 with the actuators 22 formed thereon, it is necessary to position the first row select lines 76, the first control lines 80*a*, and the second control lines 80*b* along tortuous paths between the actuators 22, and such a tortuous layout of the first row select lines 76, the first control lines 80*a*, and the second control lines 80*b* tends to lower the freedom of interconnection design and produce parasitic inductances and parasitic resistances.

According to the present embodiment, the first row select lines 76, the first control lines 80*a*, and the second control lines 80*b*, together with the drive circuits 74, are formed on the circuit board 100. Since the first row select lines 76, the first control lines 80*a*, and the second control lines 80*b* can freely be laid out and formed irrespective of the layout of the actuators 22, the freedom of interconnection design is increased, and it is expected that parasitic inductances and parasitic resistances can be reduced.

The circuit board 100 may be made of ceramics, glass, plastic (in the form of a plate or film), or the like. If the circuit board 100 is made of glass, then it should preferably be highly resistant to heat and contain few or small surface defects. Commercially available glass includes Eagle2000, Code1737 manufactured by Corning Incorporated, NA35 manufactured by Nippon Sheet Glass, and AN635 manufactured by Asahi Glass.

If the circuit board 100 is made of plastic, then it is advantageous in that it is lightweight, strong, soft, and can be manufactured according to a roll-to-roll process which is advantageous as to cost. Since plastic suffers heat resistance problems, TFTs should be fabricated at low temperatures.

Figure 12:
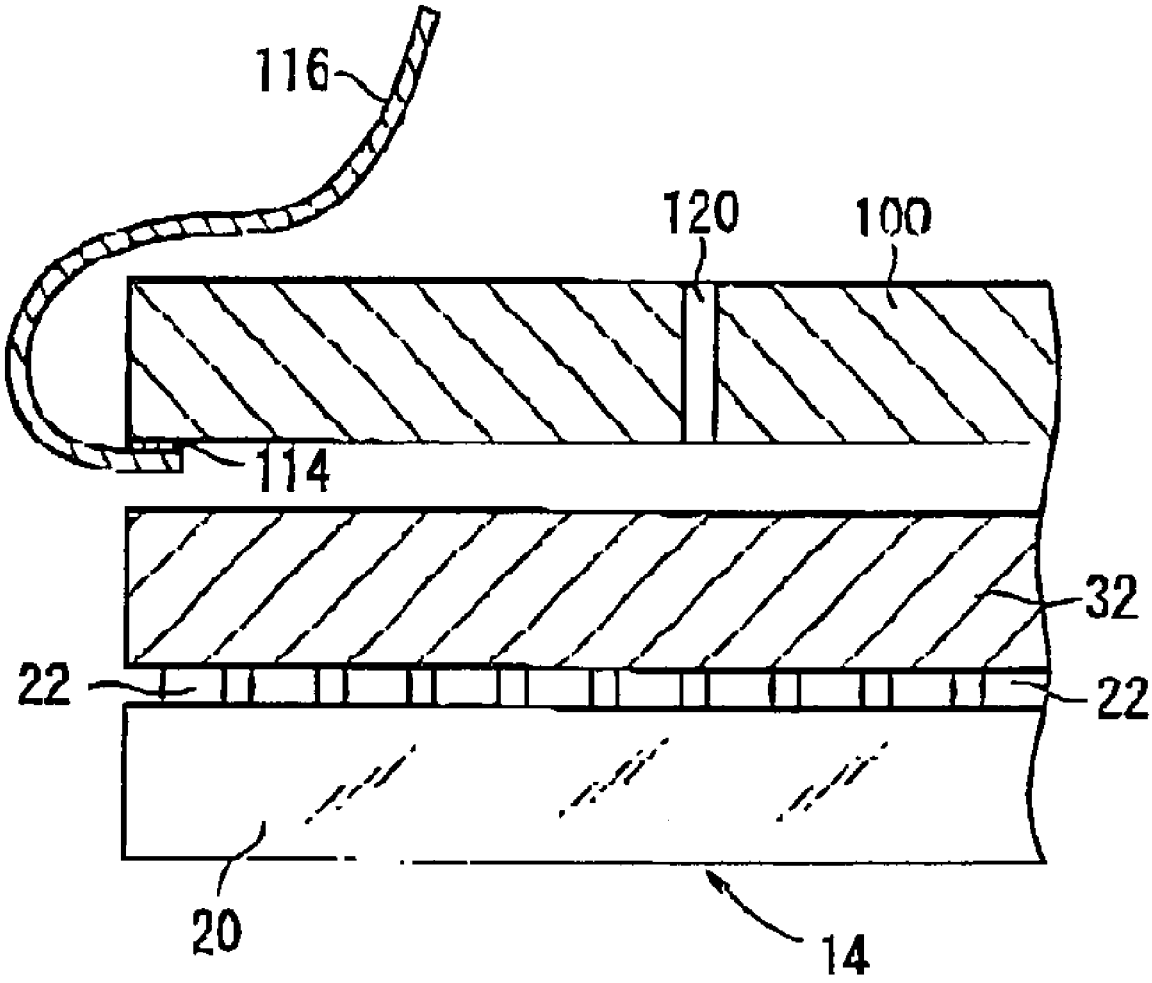
FIG. 12 is a view showing an example in which a number of wires from a drive unit on a principal surface of a circuit board extend out of the circuit board.

As shown in FIG. 10, a low-voltage logic IC 112 may be used to supply the select signals Ss to the first row select line 76, the picture element signal Sd to the picture element lines 70, and the first control signal Sc1 and the second control signal Sc2 to the first control lines 80*a* and the second control lines 80*b*. In this case, a number of interconnections from the drive unit 70 on the principal surface of the circuit board 100 need to be extended out of the circuit board 100. As shown in FIG 12, the circuit board 100 may be connected to the low-voltage logic IC 116 (see FIG. 10) from a bonded region between the actuators 22 and the circuit board 100 directly through an ACF (Anisotropic Conductive Film) 114 and a cable 116 comprising an FPC (Flexible Printed Circuit) or a TAB (Tape Automated Bonding) circuit.

However, since there is needed a space for accommodating the cable 116 therein, the gaps at the junctions between the display elements 14 become large in a large-size display device 10 which is made up of a number of display elements 14 as shown in FIG. 1.

Figure 13:
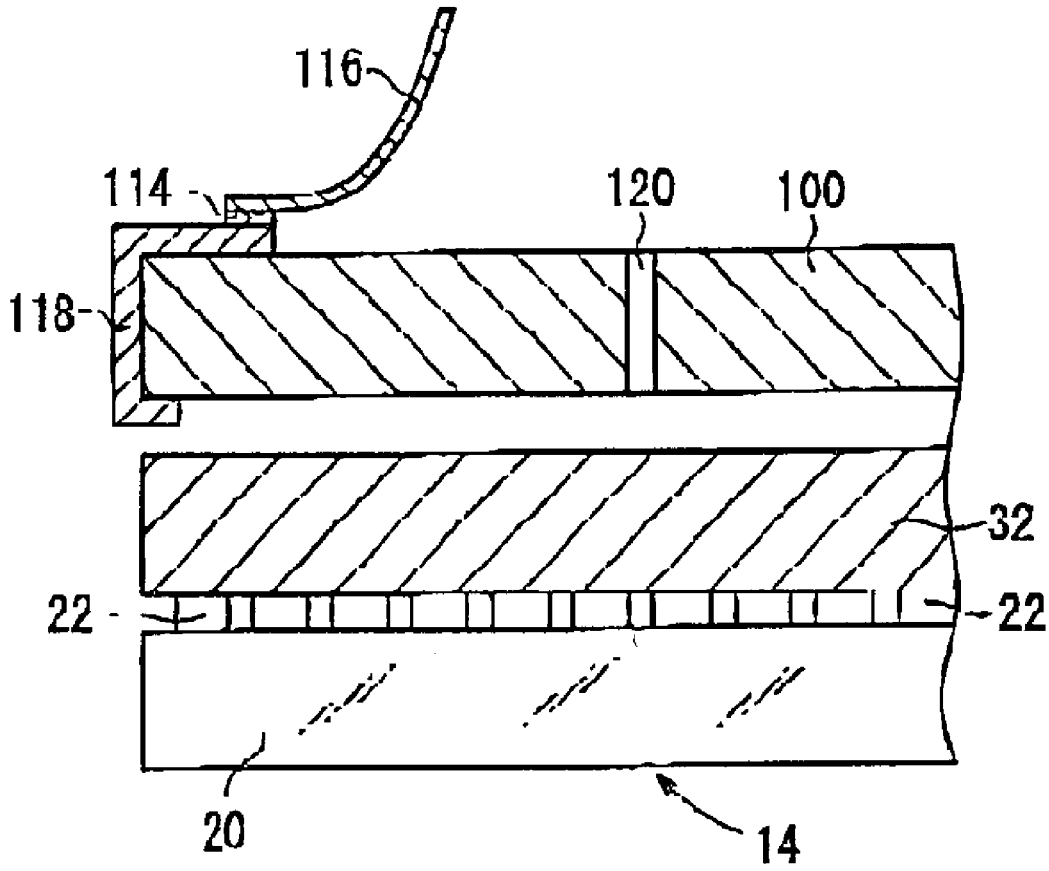
FIG. 13 is a view showing another example in which a number of wires from a drive unit on a principal surface of a circuit board extend out of the circuit board.

According to the present embodiment, if the circuit board 100 is made of glass, then, as shown in FIG. 13, an interconnection pattern 118 is printed from one principal surface of the circuit board 100 across an end thereof to the reverse side of the circuit board 100 (end face printing), where the interconnection pattern 118 is connected to the low-voltage logic TC 112 (see FIG. 10) through the ACF 114 and the cable 116.

If the circuit board 100 is made of plastic or ceramics, then, though not shown, through holes are formed in the circuit board 100 in alignment with the respective drive circuits 74, and interconnections may extend through the through holes.

With the above arrangements, the gaps at the junctions between the display elements 14 are so minimized that the joints between the display elements 14 in the large-size display device 10 are made visually less distinctive for displaying images of increased quality.

If the drive unit 70 is fabricated on the circuit board 100, it is preferable, as shown in FIGS. 12 and 13, to form one or more ventilation holes 120 in the circuit board 100. The vent hole or holes 120 serve to increase the durability of the actuators 22 and the durability of the display elements 14 and the display device 10.

A first specific example of the drive circuit 74 and the selector circuit 96 according to the present embodiment will be described below with reference to FIG. 14.

As shown in FIG. 14, the drive circuit 74A according to the first specific example comprises a drive potential generating circuit 130 for applying a drive potential Vd based on a signal from the control signal line 80 (the first control line 80*a* and the second control line 80*b*) to the upper electrode 48*b* of the actuator 22, a first logic gate 182 for inhibiting the first control signal Sc1 on the first control line 80*a* of the control signal line 80 from being inputted when not selected and allowing the first control signal Sc1 to be inputted when selected, based on the select signal Ss from the first row select line 76, and a second logic ate 134 for inhibiting the second control signal Sc2 on the second control line 80*b* of the control signal line 80 from being inputted when not selected and allowing the second control signal Sc2 to be inputted when selected. based on the select signal Ss from the first row select line 76.

As shown in FIG. 14, the first and second logic gates 132, 134 comprise respective transfer gates M1, M2. The drive potential generating circuit 130 has a series circuit 136 of two power TFTs of a large channel width which are connected between a high-level power supply (e.g., +30 V) and a low-level power supply (e.g., 0 V).

Specifically, the series circuit 136 has a p-channel power TFT (pM3) whose source is connected to the high-level power supply and an n-channel power TFT (nM4) whose source is connected to the low-level power supply. The first control signal Sc1 is connected to the gate of the power TFT (pM3) through the first logic gate 132, and the second control signal Sc2 is connected to the gate of the power TFT (nM4) through the second logic gate 134.

The junction between the power TFT (pM3) and the power TFT (nM4) of the series circuit 136, i.e., an output terminal 138 thereof, is connected to the upper electrode 48*b* of the actuator 22 through the electrode pads 106, 104 and a resistor 140.

The first logic gate 132, the second logic gate 134, the power TFT (pM3), and the power TFT (nM4) are of a four-terminal structure separate from a source terminal and having a bias terminal for its semiconductor substrate. The first logic gate 132, the second logic gate 134, and the power TFT (nM4) have a substrate potential which is set to the potential (e.g., 0 V) of the low-level power supply, and the power TFT (pM3) has a substrate potential which is set to the potential (e.g., +5 V) of the high level power supply.

The selector circuit 96 has a series circuit 142 of two power TFTs of a large channel width which are connected between a high-level power supply (e.g., +50 V) and a low-level power supply (e.g., +20 V).

Specifically, the series circuit 142 has a p-channel power TFT (pM5) whose source is connected to the high-level power supply and an n-channel power TFT (nM6) whose source is connected to the low-level power supply. A first switching signal Sw1 from a controller (not shown) is applied to the gate of the power TFT (pM5), and a second switching signal Sw2 from the controller is applied to the gate of the power TFT (nM6).

The junction between the power TFT (pM5) and the power TFT (nM6) of the series circuit 142, i.e., an output terminal 144 thereof, is connected to the lower electrode 48*a* of the actuator 22 through the electrode pads 108, 110.

In the period in which the synchronizing signal Sh is of a high level (reset period Tr), as shown in FIG. 9, both the first switching signal Sw1 and the second switching signal Sw2 are of a low level, turning on the power TFT (pM5) and turning off the power TFT (nM6), so that a select potential Vs of +50 V is applied to the lower electrode 48*a* of the actuator 22.

In the period in which the synchronizing signal Sh is of a low level (gradation expressing period Tc), both the first switching signal Sw1 and the second switching signal Sw2 are of a high level, turning off the power TFT (pM5) and turning on the power TFT (nM6), so that a select potential Vs of +20 V is applied to the lower electrode 48*a* of the actuator 22.

Operation of the drive circuit 74A and the selector circuit 96 will be described below also with reference to FIG. 9.

In the present embodiment, there is introduced a concept of resetting picture elements for extinguishing, for example, the picture elements of a row which is being selected.

Figure 15:
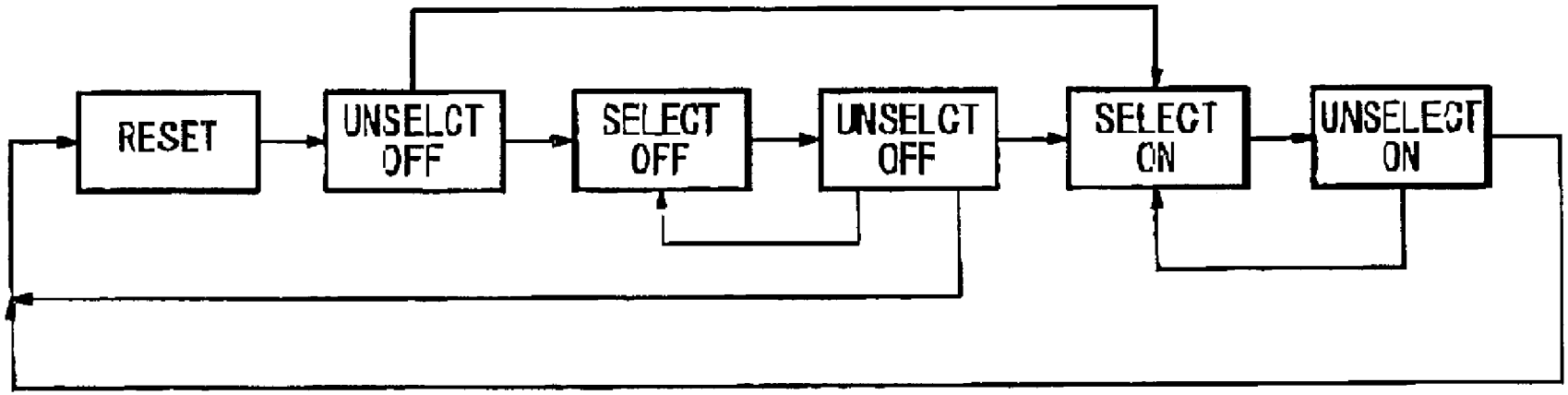
FIG. 15 is a diagram showing operation transitions in the display element according to the embodiment of the present invention.

As shown in FIG. 15, in the gradation expressing period Tc after the reset period Tr, the drive circuit operates in five modes, i.e., an unselect mode (OFF), a select mode (OFF), an unselect mode (OFF), a select mode (ON), and an unselect mode (ON), based on some regularity, depending on the attribute of the picture element signal Sd supplied to the picture elements of a selected row.

Specifically, when a signal representing picture element select is supplied from the first row select line 76 to a certain row and the attribute of the picture element signal Sd supplied to the picture elements of the selected row represents a turned-off state in the reset period Tr, a drive voltage Vc (e.g, +50 V) depending on the reset state is applied to the actuators 22 of the selected row. At this time, the picture elements of the selected row are extinguished, for example.

Thereafter a signal representing picture element unselect is supplied from the first row select line 76 to the selected row, and a drive voltage Vc (e.g., +50 V) depending on the picture element unselect and the turned-off state is applied to the actuators 22 of the selected row. At this time, the picture elements of the selected row remain extinguished.

Thereafter, when a signal representing picture element select is supplied from the first row select line 76 to the selected row, the attribute of the picture element signal Sd may represent a turned-off state or a turned-on state depending on the picture element. A drive voltage Vc (e.g., +50 V) depending on the picture element select and the turned-off state is applied to the actuators 22 of a picture element for which the attribute of the picture element signal Sd represents a turned-off state. At this time, the picture element remains extinguished, for example.

A drive voltage Vc (e.g., −10 V) depending on the picture element select and the turned-on state is applied to the actuators 22 of a picture element for which the attribute of the picture element signal Sd represents a turned-on state. At this time, the picture element is energized, for example.

Thereafter, when a signal representing picture element unselect is supplied from the first row select line 76 to the selected row, the drive voltage Vc applied when previously selected remains applied to the actuators 22 of the selected row. Those picture elements which have been turned on when selected remain energized, and those picture elements which have been turned off when selected remain extinguished.

Thereafter, when a signal representing picture element select is supplied again from the first row select line 76 to the selected row, the attribute of the picture element signal Sd may represent a turned-off state or a turned-on state depending on the picture element. If the attribute representing a turned-off state or a turned-on state when previously selected is repeated, then the drive voltage applied when previously selected remains applied to the actuators 22 of the selected row.

If the attribute of the picture element signal Sd for a certain picture element, which represented a turned-off state when previously selected, represents a turned on state when next selected, then a drive voltage depending on the picture element select and the turned-on state is applied to the actuator 22 of the picture element. At this time, the picture element is energized, for example.

If a certain picture element which was turned on when previously selected is to be turned off when selected next time, then at least the picture element has to be reset (turned off), then unselected (turned off), and selected (turned off) in a state prior to the selection, resulting in a timing misalignment.

To avoid the above shortcoming, the continuation of an energized state following the continuation of an extinguished state is carried out as a gradation expressing process for each field (or each frame) as by (1) resetting the picture elements in each field (or each frame) to express a gradation starting from the reset state, i.e., the extinguished state, and (2) controlling the timing to change from the unselected (turned off) state to the selected (turned on) state depending on the gradation, and once the picture elements are energized when selected (turned on), the energization is maintained until the picture elements are reset.

The above operation will be described below with reference to FIG. 9. When the first subfield (reset period Tr) in one field is started, a high-level synchronizing signal Sh is outputted to each of the adjusting circuits 90 (see FIG. 8) throughout the subfield.

In the display unit 24, when a row (e.g., the first row) is selected by the vertical shift circuit 82, the picture elements of the selected row are supplied with respective picture element signals Sd from the corresponding picture element signal lines 78, and the select potential Vs is applied from the corresponding selector circuit 96 through the second row select line 94 to the lower electrodes 48*a* of the actuators 22 of the selected row.

In the reset period Tr, all the attributes of the picture element signals Sd supplied to the picture elements of the selected row represent the turned-off state.

While the select signals Ss on the first row select lines 76 go high in level and the picture element signals Sd on the picture element signal lines 78 go low in level (the attribute; the turned-off state) at time t1 in FIG. 9, the first control signal Sc1 goes high in level and the second control signal Sc2 goes high in level. In the drive circuit 74A for the picture element in the first row and first column, for example, the power TFT (pM3) is turned off and the power TFT (nM4) is turned on, applying a drive potential Vd of 0 V to the upper electrode 48*b* of the actuator 22.

Since the select potential Vs of 50 V is applied to the lower electrode 48*a* at this time, a drive voltage of +50 V is applied between the lower and upper electrodes 48*a*, 48*b* of the actuator 22, which is displaced downwardly to extinguish (turn off) the picture element corresponding to the actuator 22.

Thereafter, at time t2, when the select potential Ss on the first row select line 76 goes low in level, both the first and second logic gates 132, 134 are turned off. As a result, the output impedances of the first and second logic gates 132, 134 are increased, and the high-level voltage (5 V) is held across a gate-to-substrate capacitor of each of the power TFT (pM3) and the power TFT (nM4). The power TFT (pM3) and the power TFT (nM4) remain turned off and on, respectively. The picture element corresponding to the actuator 22 thus remains turned off.

Thereafter, the gradation expressing period Tc is started from time t3, and when the select signals Ss on the first row select lines 76 are of a high level and the picture element signals Sd on the picture element signal lines 78 are of a low level (the attribute: the turned-off state), the first control signal Sc1 goes high in level and the second control signal Sc2 goes low in level. In the drive circuit 74A for the picture element in the first row and first column, for example, the power TFT (pM3) is turned off and the power TFT (nM4) is turned off. The series circuit 136 presents a high output impedance, keeping the drive voltage Vd of 0 V applied to the upper electrode 48*b* of the actuator 22.

At this time, the select potential Vs of 20 V has been applied to the lower electrode 48*a* from time t3 when the gradation expressing period Tc began. Since the series circuit 136 presents a high output impedance, the drive voltage Vc of +50 V remains applied between the lower electrode 48*a* and the upper electrode 48*b* of the actuator 22. The picture element associated with the actuator 22 remain extinguished (turned off).

Thereafter, at time t4 when the select signals Ss on the first row select liner 76 go low in level, both the power TFT (pM3) and the power TFT (nM4) remain turned off, and the picture element associated with the actuator 22 still remains turned off, as at time t2.

Thereafter, at time t5 when select signals Ss on the first row select lines 76 go high in level and the picture element signals Sd on the picture element signal lines 78 go high in level (the attribute: the turned-on state), both the first control signal Sc1 and the second control signal Sc2 go low in level. In the drive circuit 74A for the picture element in the first row and final column, for example, the power TFT (pM3) is turned on and the power TFT (nM4) is turned off. The drive voltage Vd of +30 V is applied to the upper electrode 48*b* of the actuator 22.

At this time, because the select potential Vs of 20 V has been applied to the lower electrode 48*a* from time t3 when the gradation expressing period Tc began, a drive voltage Vd of −10 V is applied between the lower electrode 48*a* and the upper electrode 48*b* of the actuator 22, which is displaced upwardly to energize (turn on) the picture element corresponding to the actuator 22.

Thereafter, at time t6 when the select signals Ss on the first row select lines 76 go low in level, the power TFT (pM3) is turned on and the power TFT (nM4) remains turned off, and the picture element associated with the actuator 22 still remains turned on, as at time t2.

The layout of interconnections and circuits on the circuit board 100 will be described below with reference to FIGS. 16 to 18.

As described above, the circuit board 100 has an array of interconnection circuit forming areas 102 (see FIG. 11) aligned respectively with the drive circuits 74A which are assigned to the respective picture elements. If the display unit 24 has a matrix of picture elements arranged in 128 rows and 128 columns, for example, then the circuit board 100 has an array of 128×128=16384 interconnection circuit forming areas 102.

Figure 16:
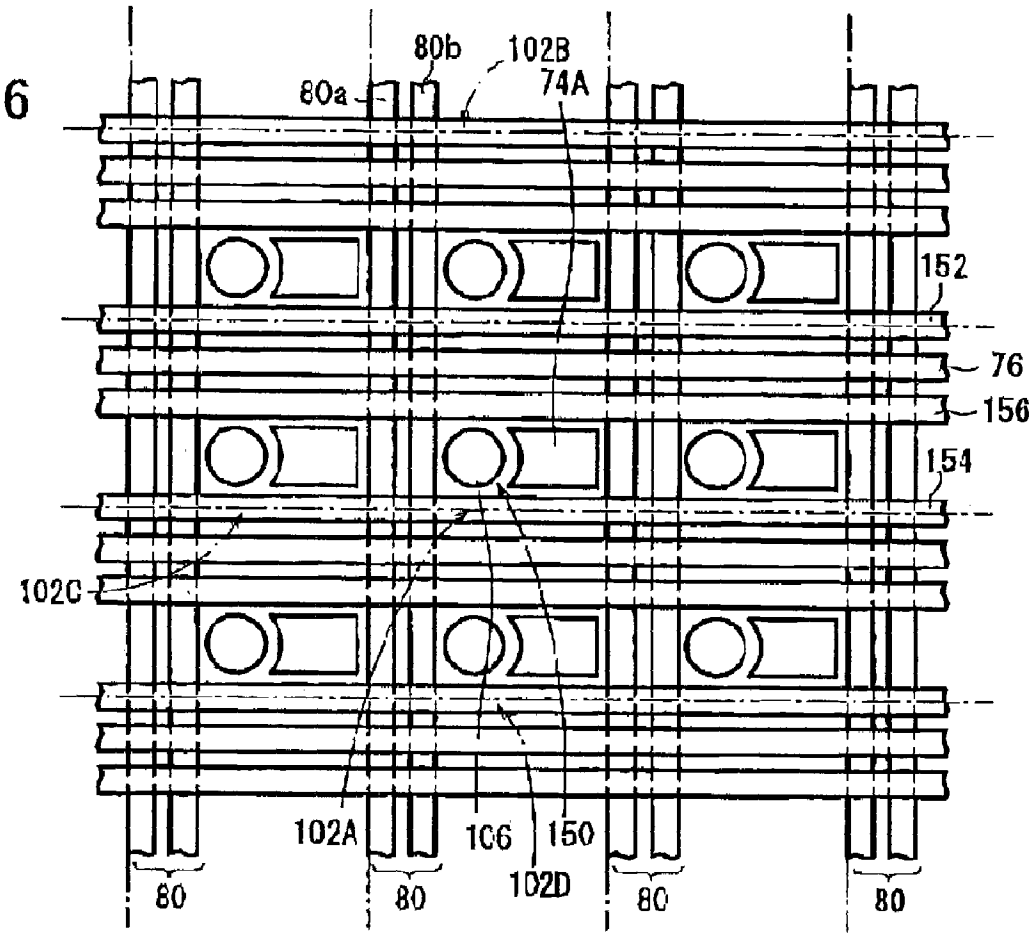
FIG. 16 is a diagram showing the layout of an interconnection circuit forming area on a circuit board corresponding to the drive circuit according to the first specific example.

As shown in FIG. 16, a central interconnection circuit forming area 102A will be described below. The central interconnection circuit forming area 102A has the first row select line 76 extending along the row in a region thereof near another interconnection circuit forming area 102B that is assigned upwardly, for example, of the interconnection circuit forming area 102A, and the control signal line 80 (the first control line 80*a* and the second signal line 80*b*) extending along the column in a region thereof near another interconnection circuit forming area 102C that is assigned leftwardly, for example, of the interconnection circuit forming area 102A.

The central interconnection circuit forming area 102A also has a circuit forming region 150 in an area defined by the first row select line 76 (actually, a bias power supply line 156 to be described later on) and the control signal line 80. The circuit forming region 150 contains the electrode pad 106 connected to the upper electrode 48*b* of the corresponding actuator 22 and the drive circuit 74A.

The central interconnection circuit forming area 102A also has a high-level power supply line 152 extending along the row in a boundary region thereof adjacent to the other interconnection circuit forming area 102B that is assigned upwardly, for example, of the interconnection circuit forming area 102A, and a low-level power supply line 154 extending along the row in a boundary region thereof adjacent to another interconnection circuit forming area 102D that is assigned downwardly, for example, of the interconnection circuit forming area 102A. The bias power supply line 156 extends along the row between the first row select line 76 and the circuit forming region 150 for supplying a substrate potential to the power TFT (pM3).

Figure 17:
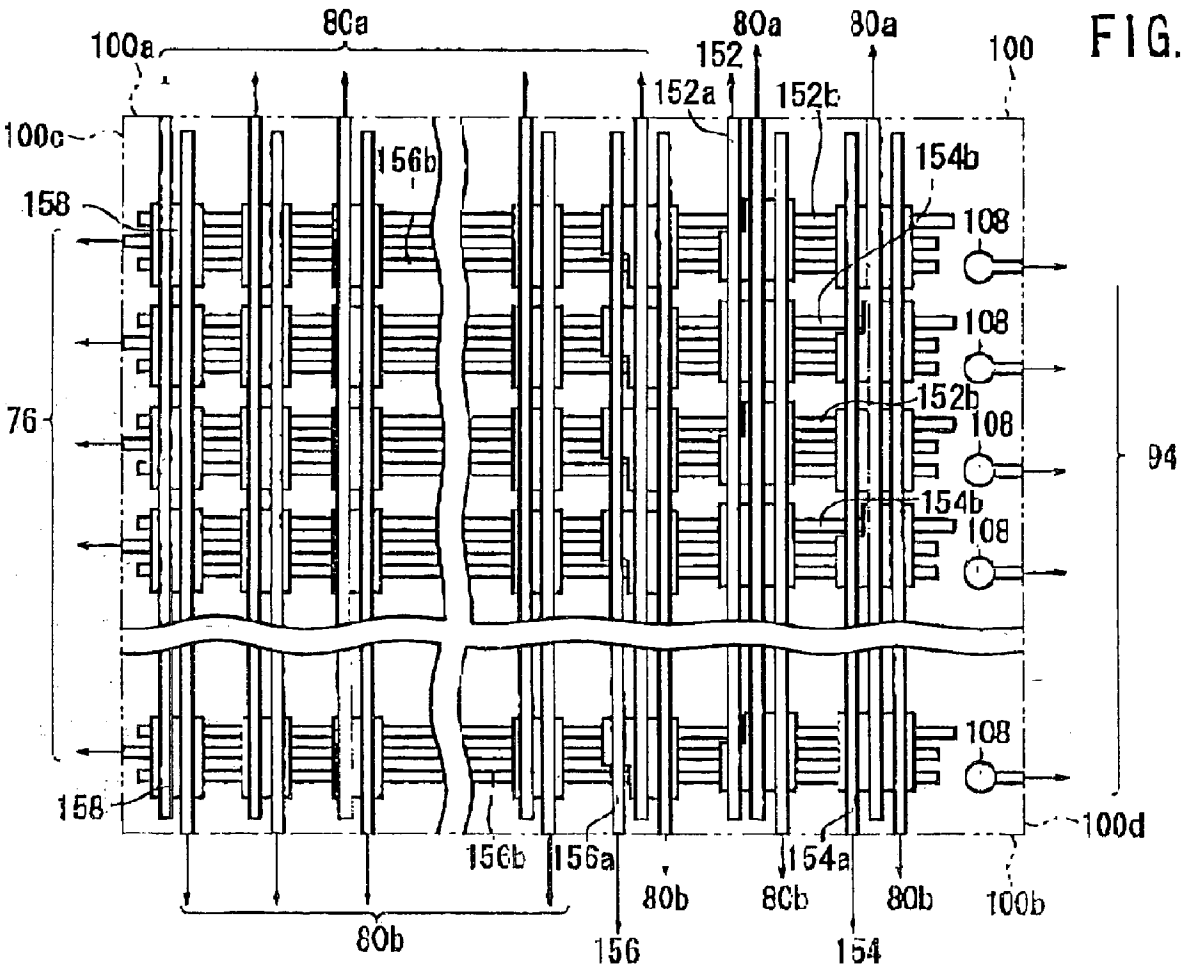
FIG. 17 is a diagram showing the layout of various interconnections on the circuit board corresponding to the drive circuit according to the first specific example.

As shown in FIG. 17, the first control lines 80*a* are printed from the reverse surface of the circuit board 100 across a first end 100*a* thereof to the face surface of the circuit board 100 which is bonded to the actuator substrate 32 (end face printing). The first control lines 80*a* are printed on the face surface of the circuit board 100 so as to extend along the columns.

Figure 18:
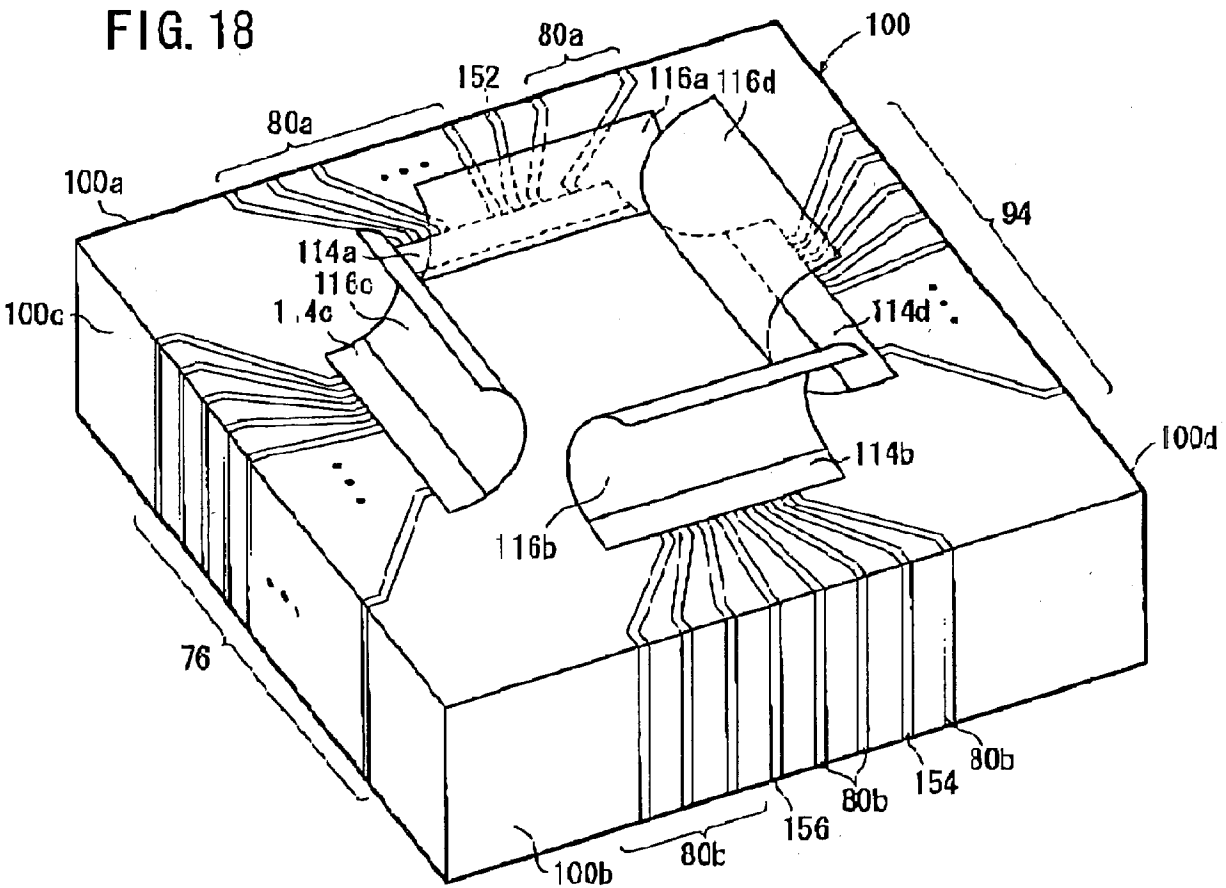
FIG. 18 is a perspective view showing an example in which various interconnections extend to the reverse side of the circuit board.

As shown in FIG. 18, the first control lines 80*a* are connected from the reverse surface of the circuit board 100 to a low-voltage logic IC (not shown) through a first ACF 114*a* and a first cable 116*a*.

Similarly, as shown in FIG. 17, the second control lines 80*b* are printed from the reverse surface of the circuit board 100 across a second end 100*b* thereof (opposite to the first end 100*a* across which the first control lines 80*a* are printed) to the face surface of the circuit board 100 (end face printing). The second control lines 80*b* are printed on the face surface of the circuit board 100 so as to extend along the columns. As shown in FIG. 18, the second control lines 80*a* are connected from the reverse surface of the circuit board 100 to a low-voltage logic IC (not shown) through a second ACF 114*b* and a second cable 116*b*.

As shown in FIG. 17, the first row select lines 76 are printed from the reverse surface of the circuit board 100 across a third end 100*c* thereof to the face surface of the circuit board 100 (end face printing). The first row select lines 76 are printed on the face surface of the circuit board 100 so as to extend along the rows. As shown in FIG. 18, the first row select lines 76 are connected from the reverse surface of the circuit board 100 to a low-voltage logic IC (not shown) through a third ACF 114*c* and a third cable 116*c*.

Insulating layers 158 are interposed between the first and second control lines 80*a*, 80*b* which extend along the columns and the first row select lines 76 which extend along the rows, in areas where they cross each other, preventing the first and second control lines 80*a*, 80*b* and the first row select lines 76 from being electrically connected to each other. Similar insulating layers are provided for electrically isolating them from various power supply lines. In FIG. 16, the insulating layers 158 are omitted from illustration.

As shown in FIG. 17, the second row select lines 94 are printed from the reverse surface of the circuit board 100 across a fourth end 100*d* thereof (opposite to the third and 100*c* across which the first row select lines 76 are printed) to the face surface of the circuit board 100 (end face printing). The second row select lines 94 are further printed up to the corresponding electrode pads 108. As shown in FIG. 18, the second row select lines 94 are connected from the reverse surface of the circuit board 100 to a low-voltage logic IC (not shown) through a fourth ACF 114*d* and a fourth cable 116*d*.

As shown in FIG. 17, the high-level power supply line 152 is printed from the reverse surface of the circuit board 100 across the first end 100*a* thereof to the face surface of the circuit board 100 (end face printing). The high-level power supply line 152 has a first lead-in line 152*a* extending along the column and a plurality of first branch lines 152*b* branched from the first lead-in line 152*a* along odd-numbered rows, for example. As shown in FIG. 18, the high-level power supply line 152 is connected from the reverse surface of the circuit board 100 to a power supply circuit (not shown) through the first ACF 114*a* and the first cable 116*a*.

As shown in FIG. 17, the low-level power supply line 154 in printed from the reverse surface of the circuit board 100 across the second end 100*b* thereof to the face surface of the circuit board 100 (end face printing). The low-level power supply line 154 has a second lead-in line 154*a* extending along the column and a plurality of second branch lines 154*b* branched from the second lead-in line 154*a* along even-numbered rows, for example. As shown in FIG. 18, the low-level power supply line 154 is connected from the reverse surface of the circuit board 100 to the power supply circuit (not shown) through the second ACF 114*b* and the second cable 116*b*.

The bias power supply line 156 is printer from the reverse surface of the circuit board 100 across the second end 100*b* thereof to the face surface of the circuit board 100 (end face printing). The bias power supply line 156 has a third lead-in line 156*a* extending along the column and a plurality of third branch lines 156*b* branched from the third lead-in line 156*a* along the rows. As shown in FIG. 18, the bias power supply line 156 is connected from the reverse surface of the circuit board 100 to the power supply circuit (not shown) through the second ACF 114*b* and the second cable 116*b*.

In the layout of the drive circuit 74A, as described above, the first row select line 76 extending along the row is formed in the region of the interconnection circuit forming area 102A near the other interconnection circuit forming area 102B that is assigned upwardly, upwardly, of the interconnection circuit forming area 102A, and the control signal line 80 extending along the column is formed in the region of the interconnection circuit forming area 102A near the other interconnection circuit forming area 102C that is assigned leftwardly, for example, of the interconnection circuit forming area 102A. Because the interconnections are assigned to the end regions of the interconnection circuit forming area 102A, a wide region is assigned as the circuit forming region 150 defined by the first row select line 76 (in FIG. 16, the bias power supply line 156) and the control signal line 80.

Consequently, if the drive circuit 74A is constructed as a circuit including a plurality of thin-film transistors, then the freedom about the size and layout of each of the thin-film transistors is increased.

The high-level power supply line 152, for example, is formed in the boundary region between the interconnection circuit forming area 102A and the other interconnection circuit forming area 102B that is assigned upwardly, for example, of the interconnection circuit forming area 102A, and the low-level power supply line 154, for example, is formed in the boundary region between the interconnection circuit forming area 102A and the other interconnection circuit forming area 102D that is assigned downwardly, for example, of the interconnection circuit forming area 102A. Thus, it is possible to form the high-level power supply line 152 and the low-level power supply line 154 in every other row, so that the number of the power supply lines 152, 154 can effectively be reduced.

Inasmuch as the power supply lines 152, 154 are formed in the end regions of the interconnection circuit forming area 102A, any reduction in the area of the interconnection circuit forming area 102A due to the inclusion of the power supply lines 152, 154 therein is small.

As shown in FIG. 17, the electrode pads 108 connected to the selector circuits 96 are formed in a peripheral portion of the circuit board 100 (near the fourth end 100*d*). Thus, the interconnection circuit forming areas 102 can be formed irrespective of the presence of the electrode pads 108 connected to the selector circuits 96, and the areas of the interconnection circuit forming areas 102 are not reduced by the electrode pads 108.

The first control lines 80*a* are extended across the first and 100*a* of the circuit board 100, the second control lines 80*b* are extended across the second end 100*b* of the circuit board 100, and the first row select lines 76 are extended across the third end 100*c* of the circuit board 100. Consequently, the first control lines 80*a* and the second control lines 80*b* can be extended linearly along the respective columns, and the first row select lines 76 can be extended linearly along the respective rows.

Therefore, any increase in the parasitic inductance and parasitic resistance in each of the interconnections is suppressed, thus suppressing any reduction in the signal transfer efficiency along each of the interconnections. In each of the interconnection circuit forming areas 102, furthermore, it is possible to form the first control lines 80*a* and the second control lines 80*b* which extend along the columns, and the first row select lines 76 which extend along the rows.

The branch lines (the first branch lines 152*b*) of the high-level power supply line 152 are extended along the odd-numbered lines, for example, and the branch lines (the second branch lines 154*b*) of the low-level power supply line 154 are extended along the even-numbered lines, for example. Thus, a single power supply line is extended along one row, so that the number of power supply lines can greatly be reduced. This leads to minimizing any reduction in the area of the circuit forming region 150 in each of the interconnection circuit forming areas 102.

Since lead-in interconnections from external sources to the high-level power supply line 152 and the low-level power supply line 154 are provided by the respective first and second lead-in lines 152*a*, 154*a*, interconnections for introducing power supply lines can be provided without obstructing the interconnections of the first control lines 80*a* and the second control lines 80*b* which are extended along the respective columns.

The above interconnections (the first control lines 80*a*, the second control lines 80*b*, the first row select lines 76, the high-level power supply line 152, the low-level power supply line 154, the bias power supply line 156, and the second row select lines 94) are provided by end face printing on the corresponding ends of the circuit board 100. Therefore, if a large-size display device 10 is constructed of a number of display elements 14 as shown in FIG. 1, the gaps at the junctions between the display elements 14 can be reduced as much as possible, making the joints between the display elements 14 visually less distinctive for displaying images of increased quality.

If a large-size display device 10 is constructed of a number of display elements 14, then the second row select lines 94 of the corresponding rows in the respective display elements 14 may be connected in common to a corresponding single selector circuit 96. For example, the second row select lines 94 of the first rows in the respective display elements 14 are connected in common to the selector circuit 96 corresponding to the first rows. In this manner, the selector unit 72 is simplified in arrangement, thus simplifying the circuit arrangement of the display device 10.

A drive circuit 74B according to a second specific example will be described below with reference to FIGS. 19 to 21. Those parts of the drive circuit 74B which correspond to those shown in FIGS. 14, 16, and 17 are denoted by identical reference characters, and will not be described in detail below.

The drive circuit 74B is of substantially the same arrangement as the drive circuit 74A, but differs therefrom in that the series circuit 136 connected between the high-level power supply and the low-level power supply has an n-channel power TFT (nM3) and an n-channel power TFT (nM4).

With the drive circuit 74B, the substrate potentials of the first logic gate 132, the second logic gate 134, the power TFT (nM3), and the power TFT (nM4) can be set to the potential (e.g., 0 V) of the low-level power supply, so that the bias power supply line 156 may be dispensed with.

Figure 20:
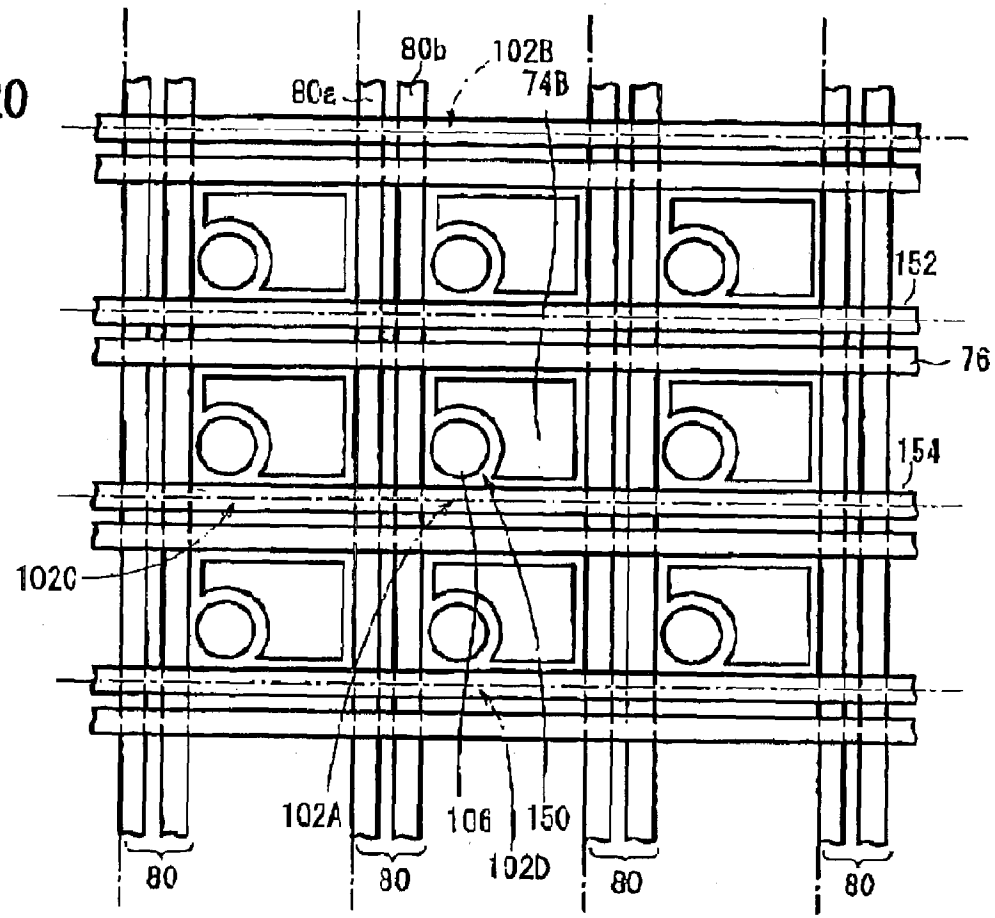
FIG. 20 is a diagram showing the layout of an interconnection circuit forming area on a circuit board corresponding to the drive circuit according to the second specific example.

Therefore, as shown in FIG. 20, no bias power supply lines 156 (see FIG. 16) are required to be formed in the interconnection circuit forming areas 102 (see FIG. 11) including the interconnection circuit forming areas 102A to 102D, thus increasing the area of the circuit forming regions 150 and further increasing the freedom of designing the layout of the drive circuits 74B. In FIG. 20, the insulating layers 158 are omitted from illustration.

Figure 21:
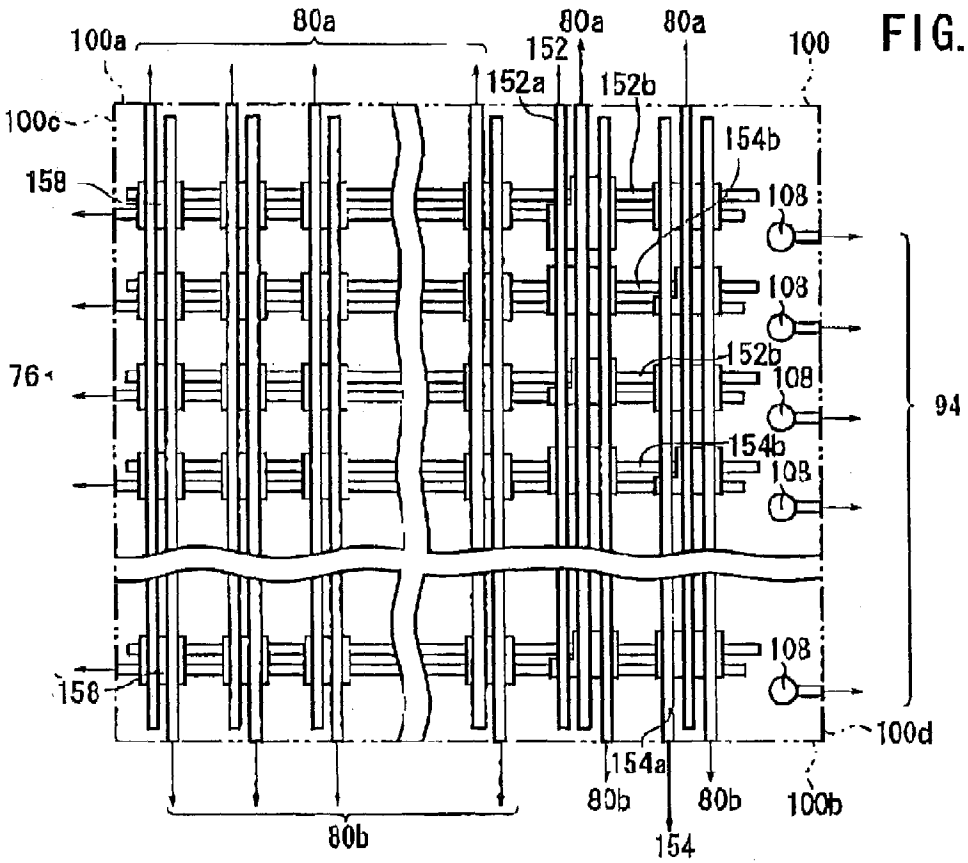
FIG. 21 is a diagram showing the layout of various interconnections on the circuit board corresponding to the drive circuit according to the second specific example.
Figure 22:
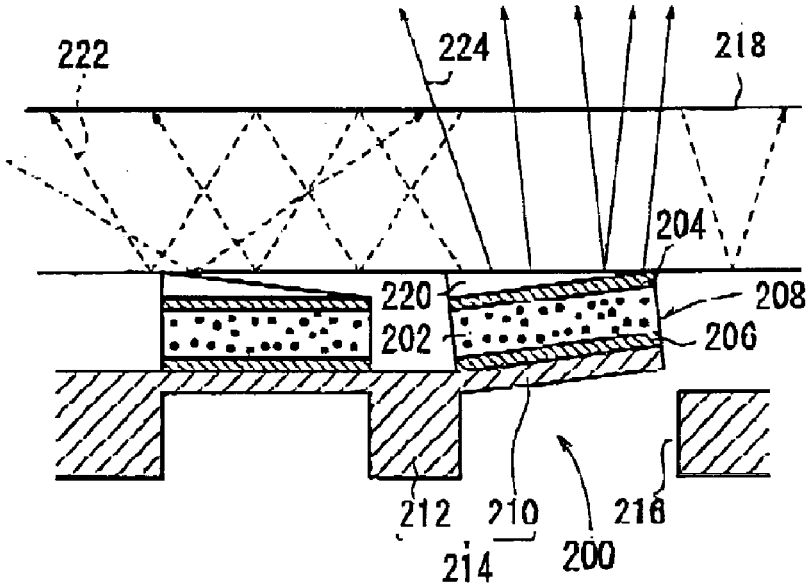
FIG. 22 is a view showing a proposed display device.
Figure 23:
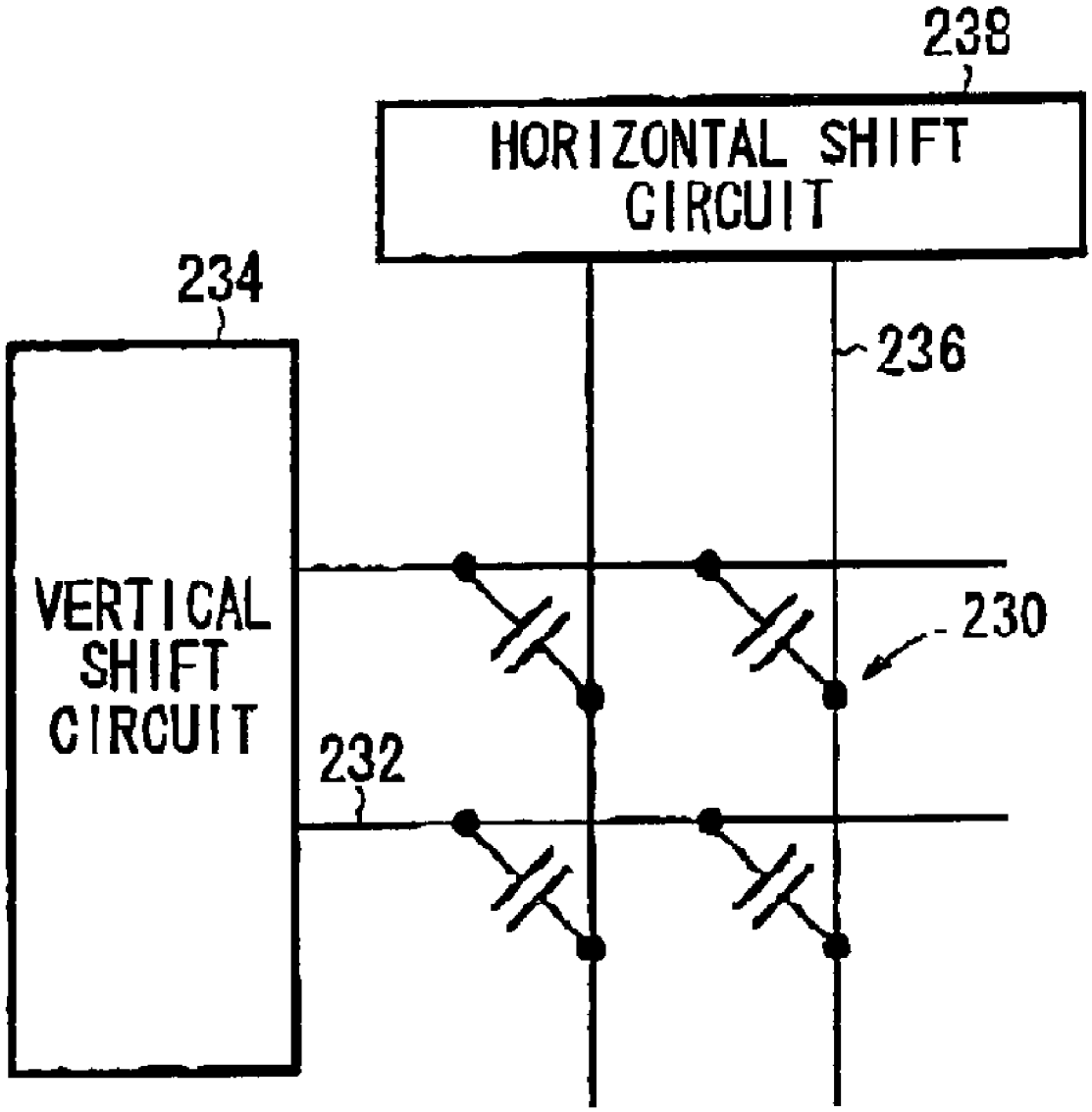
FIG. 23 is a block diagram showing peripheral circuits of the proposed display device.
Figure 24:
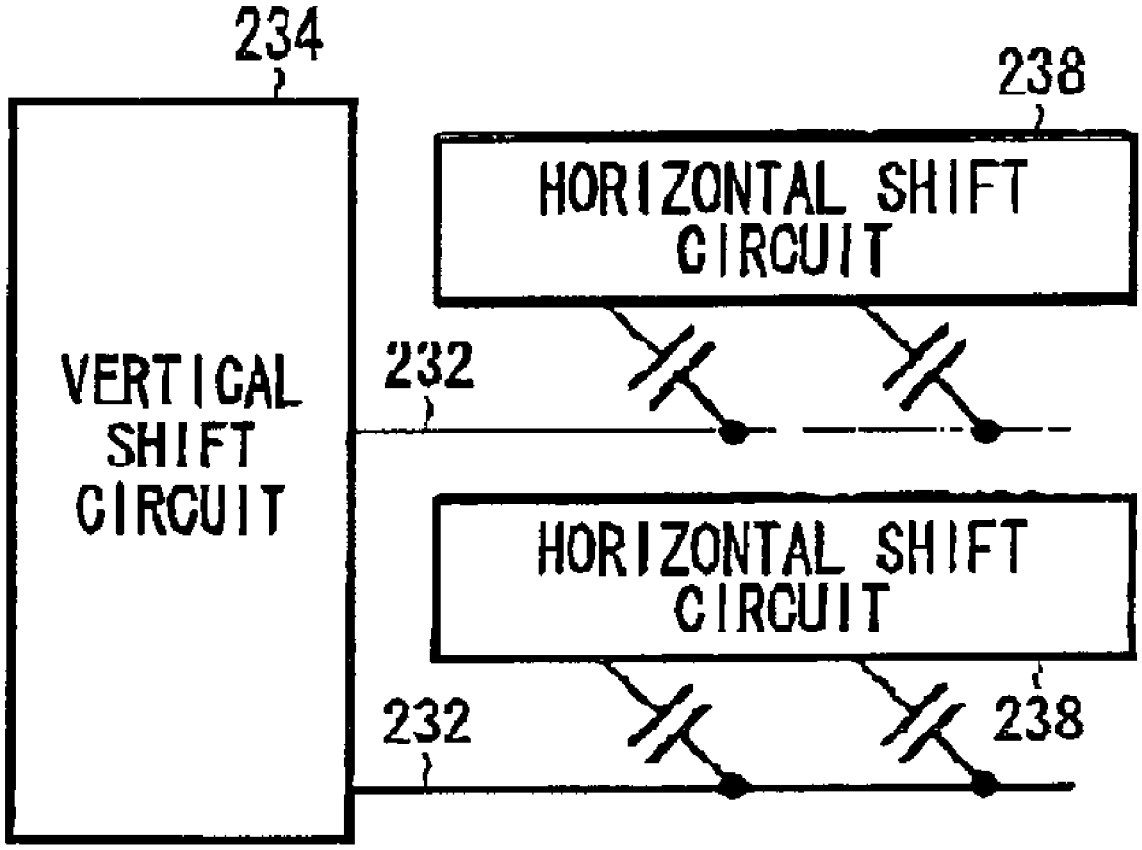
FIG. 24 is a block diagram showing other peripheral circuits of the proposed display device.
Figure 25:
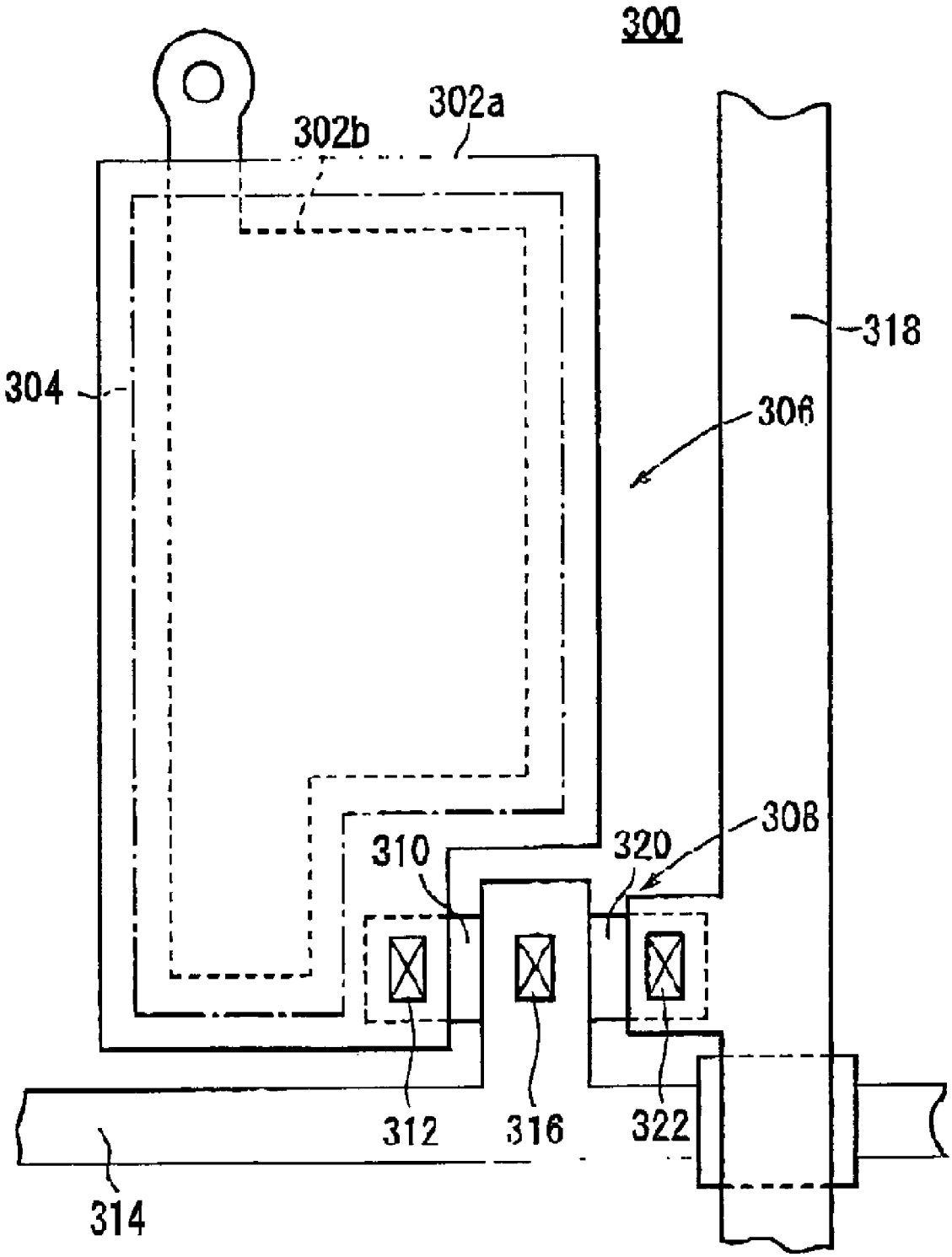
FIG. 25 is a plan view showing an actuator and its peripherals of another proposed display device.

As shown in FIG. 21, the third branch lines 156*b* and the lead-in lines (the third lead-in lines 156*a*) of the bias power supply lines 156 to be formed in the respective rows are also not required to be formed on the surface of the circuit board 100, resulting in a further increase in the freedom in designing the layout of interconnections.

The display device can use materials, such as CdSe or the like, which can be processed to form only n-channel elements, and can use materials which can be processed to form only n-channel enhancement mode FETs.

In order to be make the display device compatible with the drive circuit 74B, the attributes of the first control signal Sc1 and the second control signal Sc2 outputted from each of the adjusting circuits 90 (see FIG. 8) are set as follows. In the period in which the synchronizing signal Sh is of a high level (reset period Tr), as shown in FIG. 9, since the picture elements need to be turned off, the output signal from the drive potential generating circuit 130 may be set to a low level. To this end, the first control signal Sc1 may be set to a low level and the second control signal Sc2 may be set to a high level.

In the period in which the synchronizing signal Sh is of a low level (gradation expressing period Tc), if the attribute of the picture element signal Sd represents a turned-off state (low level), then the drive potential generating circuit 130 may present a high output impedance. To this end, both the first control signal Sc1 and the second control signal Sc2 may be set to a low level.

In the period in which the synchronizing signal Sh is of a low level (gradation expressing period Tc), if the attribute of the picture element signal Sd represents a turned-on state (high level), then the output signal from the drive potential generating circuit 130 may be set to a high level. To this end, the first control signal Sc1 may be set to a high level and the second control signal Sc2 may be set to a low level.

Figure 19:
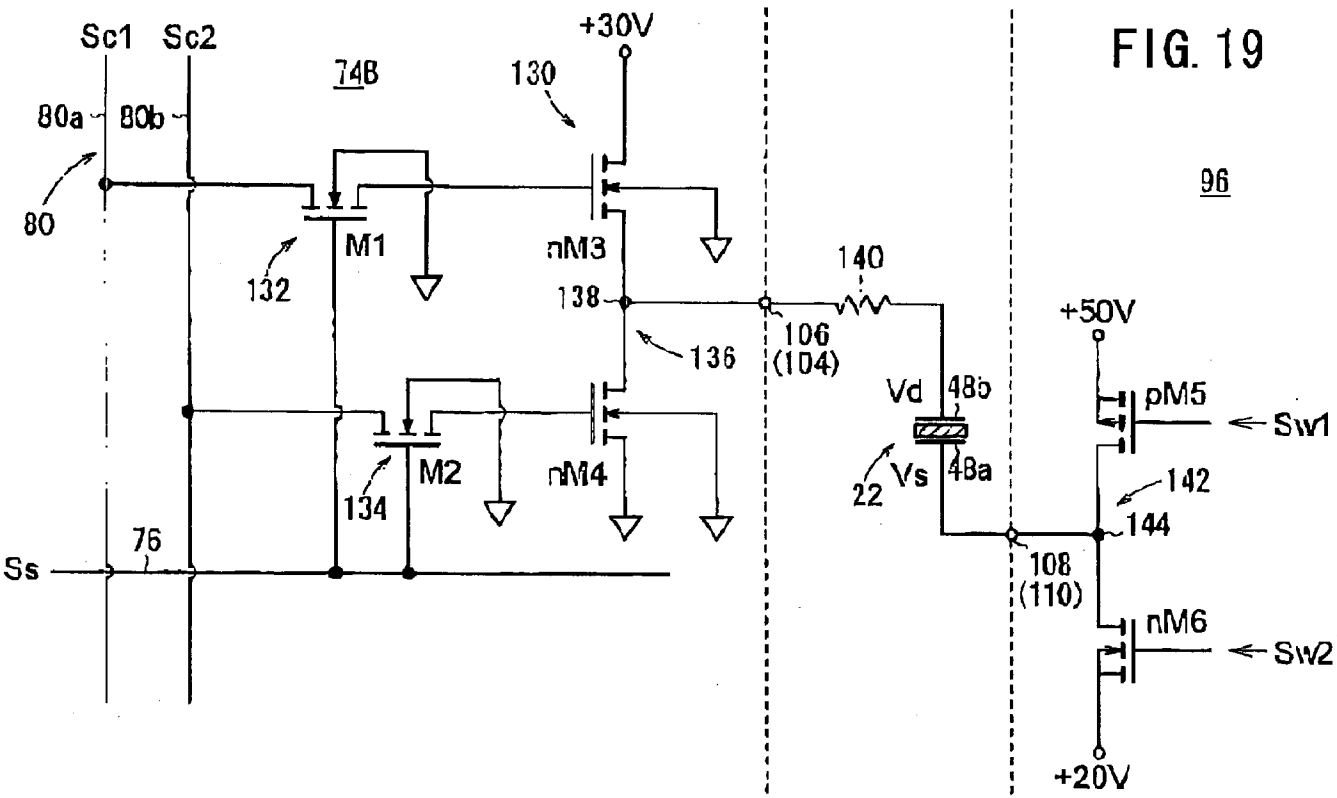
FIG. 19 is a circuit diagram of a drive circuit and a selector circuit according to a second specific example.

In the selector circuit 96 shown in FIGS. 14 and 19, the p-channel power TFT (pM5) and the n-channel power TFT (nM6) are connected in series with each other. Alternatively, as with the series circuit 136 in the drive circuit 74B shown in FIG. 19, the selector circuit 96 may have a series circuit of n-channel power TFTs.

The display device according to the present invention is free of the withstand voltage problem of switching elements for displacing actuators even if TFTs are used as the switching elements, and allows the actuators to have a sufficient area (picture element aperture ratio).

The display device according to the present invention is capable of optimizing the layout of various interconnections, allowing drive circuits to be formed without reducing the area of actuators, and providing a sufficient picture element aperture ratio.

Although certain preferred embodiments of the present invention have been shown and described in detail, it should be understood that various changes and modifications may be made therein without departing from the scope of the appended claims.

What is claimed is:

1. A display device comprising:

a display unit having capacitive elements arrayed so as to correspond respective picture elements and displaceable for turning on and off the corresponding picture elements;

each of said capacitive elements having a capacitor structure having a pair of electrodes;

a plurality of select lines for supplying the picture elements with instructions of selection and unselection;

a plurality of signal lines for supplying respective picture element signals to each of the picture elements which have been selected;

a drive unit having drive circuits arrayed so as to correspond respective picture elements and driving an capacitive element selected from said capacitive elements in response to an instruction from one of the select lines and a signal from one of the signal lines; and a selector unit for selecting said capacitive element which corresponds to the selected respective picture elements;

each of said drive circuits having a drive potential generating circuit for applying a drive potential based on the signal from said signal line to one of electrodes having said capacitive element;

said selector unit having selector circuits for applying select potentials to the other of the electrodes having said capacitive element corresponding to the selected picture elements.

2. A display device according to claim 1, wherein each of said drive circuits controls said drive potential generating circuit to translate an output thereof into three states based on the signal from said signal line.

3. A display device according to claim 2, wherein each said drive circuits comprises:

a first logic gate for inhibiting a first signal from being inputted from a first control line included in said signal line when not selected and allowing said first signal to be inputted from said first control line when selected based on a select signal from one of said select lines; and a second logic gate for inhibiting a second signal from being inputted from a second control line included in said signal line when not selected and allowing said second signal to be inputted from said second control line when selected based on the select signal from said select line;

wherein each of said drive circuits controls said drive potential generating circuit to translate the output thereof into three states based on first and second signals from said signal line.

4. A display device according to claim 2, wherein one of said three states comprises a state in which said drive potential generating circuit has a high output impedance.

5. A display device according to claim 3, wherein said drive potential generating circuit has a series circuit of a first thin-film transistor and a second thin-film transistor which are connected between a high-level power supply and a low-level power supply, the arrangement being such that said first signal is applied to a gate of said first thin-film transistor and said second signal is applied to a gate of said second thin-film transistor.

6. A display device according to claim 5, wherein a potential difference between said high-level power supply and said low-level power supply is lower than a maximum voltage which is applied between the electrodes of said capacitive element.

7. A display device according to claim 5, wherein said first thin-film transistor has a channel of a first conductivity type and said second thin-film transistor has a channel of a second conductivity type.

8. A display device according to claim 5, wherein said first thin-film transistor and said second thin-film transistor have respective channels of the same conductivity type.

9. A display device according to claim 1, wherein said selector circuit has a series circuit of a third thin-film transistor and a fourth thin-film transistor which are connected between a high-level power supply and a low-level power supply, said series circuit having a common drain connected to the other of the electrodes of said capacitive element.

10. A display device according to claim 9, wherein a potential difference between said high-level power supply and said low-level power supply is lower than a maximum voltage which is applied between the electrodes of said capacitive element.

11. A display device according to claim 9, wherein said third thin-film transistor has a channel of a first conductivity type and said fourth thin-film transistor has a channel of a second conductivity type.

12. A display device according to claim 9, wherein said third thin-film transistor and said fourth thin-film transistor have respective channels of the same conductivity type.

13. A display device according to claim 1, wherein each of said selector circuits is assigned commonly to a row of said picture elements.

14. A display device according to claim 1, further including a first board and a second board, at least said capacitive elements being disposed on said first board, at least said driver unit being disposed on said second board, said first board and said second board being bonded to each other.

15. A display device according to claim 14, wherein said second board has a plurality of interconnection circuit forming areas associated respectively with said drive circuits, each of said interconnection circuit forming areas having:

a select line extending in a row direction in a region near another one of the interconnection circuit forming areas which is assigned upwardly or downwardly of said each interconnection circuit forming area;

a signal line extending in a column direction in a region near another one of the interconnection circuit forming areas which is assigned leftwardly or rightwardly of said each interconnection circuit forming area; and an electrode pad connected to said one of the electrodes of the corresponding capacitive element, said electrode pad and said drive circuit being disposed in a circuit forming region defined by said select line and said signal line.

16. A display device according to claim 15, wherein said drive potential generating circuit has a series circuit of a first thin-film transistor and a second thin-film transistor which are connected between a high-level power supply and a low-level power supply, each of said interconnection circuit forming areas further having:

a high-level power supply line extending in the row direction in a region thereof shared by another one of the interconnection circuit forming areas which is assigned upwardly or downwardly of said each interconnection circuit forming area; and a low-level power supply line extending in the row direction in a region thereof shared by another one of the interconnection circuit forming areas, other than said other of the interconnection circuit forming areas, which is assigned upwardly or downwardly of said each interconnection circuit forming area.

17. A display device according to claim 14, wherein each of said selector circuits is assigned commonly to a row of said picture elements, said second board having electrode pads disposed in peripheral regions thereof and connected to said selector circuits, respectively, said electrode pads being connected to interconnections extending to ends of said second board.

18. A display device according to claim 14, wherein each of said drive circuits comprises:

a first logic gate for inhibiting a first signal from being inputted from a first control line included in said signal line when not selected and allowing said first signal to be inputted from said first control line when selected based on a select signal from one of said select lines; and a second logic gate for inhibiting a second signal from being inputted from a second control line included in said signal line when not selected and allowing said second signal to be inputted from said second control line when selected based on the select signal from said select line;

wherein for controlling said drive potential generating circuit to translate the output thereof into three states based on first and second signals from said signal line, said first control line is extended across one end of said second board in the column direction;

said second control line is extended across another end, opposite to said one end, of said second board; and said select line is extended across an end of said second board in said row direction.

19. A display device according to claim 18, wherein said first control line, said second control line, and said select line are extended across the corresponding ends of said second board to a reverse surface of said second board by end face printing.

20. A display device according to claim 18, wherein said drive potential generating circuit has a series circuit of a first thin-film transistor and a second thin-film transistor which are connected between a high-level power supply and a low-level power supply;

said high-level power supply having at least one first lead-in line extending in the column direction from one of the ends of said second board, and a plurality of branch lines branched from said first lead-in line along odd-numbered rows or even-numbered rows;

said low-level power supply having at least one second lead-in line extending in the column direction from one of the ends of said second board, and a plurality of branch lines branched from said second lead-in line along rows which are different from the rows along which said first branch lines are branched.

21. A display device according to claim 20, wherein at least said first lead-in line and said second lead-in line are extended across the corresponding ends of said second board to a reverse surface of said second board by end face printing.

22. A display device according to claim 17, wherein the interconnections extending from said electrode pads are extended across the ends of said second board to a reverse surface of said second board by end face printing.

23. A display device according to claim 1, wherein said capacitive element is an actuator.

* * * * *

UNITED STATES PATENT AND TRADEMARK OFFICE

CERTIFICATE OF CORRECTION

PATENT NO. : 7,006,061 B2 
DATED : February 28, 2006
INVENTOR(S) : Yukihisa Takeuchi et al.

It is certified that error appears in the above-identified patent and that said Letters Patent is hereby corrected as shown below:

Title page,
Item [56], References Cited, FOREIGN PATENT DOCUMENTS, add:
-- GB 2 251 511 A 7/1992 --.
Item [57], ABSTRACT,
Line 9, change "drives" to -- drive --.

Column 1,
Line 2, add:
-- Cross Reference to Related Applications
This application is a continuation-in-part application of U.S. Application Serial No. 10/280,106, filed October 24, 2002, now abandoned, which is a continuation-in-part application of U.S. Application Serial No. 10/163,069, filed June 5, 2002, now abandoned, the entireties of which are incorporated herein by reference. --.

Signed and Sealed this

Twenty-third Day of May, 2006

JON W. DUDAS
*Director of the United States Patent and Trademark Office*